US006473583B2

(12) United States Patent
Watanabe

(10) Patent No.: US 6,473,583 B2
(45) Date of Patent: Oct. 29, 2002

(54) IMAGE FORMING APPARATUS HAVING HEATING AND COOLING UNITS

(75) Inventor: Takeshi Watanabe, Ichikawa (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/124,394

(22) Filed: Apr. 18, 2002

(65) Prior Publication Data

US 2002/0110391 A1 Aug. 15, 2002

Related U.S. Application Data

(62) Division of application No. 09/667,551, filed on Sep. 22, 2000, now Pat. No. 6,397,030.

(30) Foreign Application Priority Data

Sep. 22, 1999 (JP) ..... 11-269265

(51) Int. Cl.[7] ..... G03G 15/10

(52) U.S. Cl. ..... 399/237; 358/300; 399/51; 399/57; 399/233

(58) Field of Search ..... 399/237, 233, 399/57, 53, 54, 51; 347/228, 232, 140; 358/401, 296, 300

(56) References Cited

U.S. PATENT DOCUMENTS

| | | | | |
|---|---|---|---|---|
| 5,148,222 A | | 9/1992 | Lior et al. | |
| 5,155,528 A | * | 10/1992 | Morishige et al. | 399/233 |
| 5,166,734 A | | 11/1992 | Pinhas et al. | |
| 5,208,637 A | | 5/1993 | Landa | |
| 5,455,661 A | | 10/1995 | Yoshida et al. | |
| 5,576,815 A | | 11/1996 | Teschendorf et al. | |
| 5,610,694 A | * | 3/1997 | Lior et al. | |
| 5,666,616 A | * | 9/1997 | Yoshino et al. | 399/237 |
| 5,745,826 A | | 4/1998 | Chang et al. | |
| 5,805,967 A | | 9/1998 | De Bock et al. | |
| 5,978,631 A | | 11/1999 | Lee | |
| 6,141,026 A | | 10/2000 | Domoto et al. | |
| 6,178,304 B1 | | 1/2001 | Sakai | |
| 6,195,514 B1 | | 2/2001 | Kim | |

FOREIGN PATENT DOCUMENTS

| | | |
|---|---|---|
| JP | 46-41679 | 12/1971 |
| JP | 62-280882 | 12/1987 |

* cited by examiner

*Primary Examiner*—Susan S. Y. Lee
(74) *Attorney, Agent, or Firm*—Foley & Lardner

(57) ABSTRACT

An image forming apparatus includes an image processing circuit for, when a determination circuit for determining an image signal determines that the image signal is an image signal that makes a liquid toner film have a predetermined thickness or less, performing predetermined processing for the image signal, an electrostatic latent image forming section for forming an electrostatic latent image on the image carrier by irradiating the image carrier with a light from exposure means on the basis of the image signal subjected to the predetermined processing, a developing unit for developing the image on the image carrier by using the liquid toner in accordance with the electrostatic latent image, and a transfer section for transferring the image on the image carrier onto the recording medium. With this arrangement, a sharp image can be formed by removing low-density areas produced in liquid toner.

6 Claims, 15 Drawing Sheets

FIG. 6B
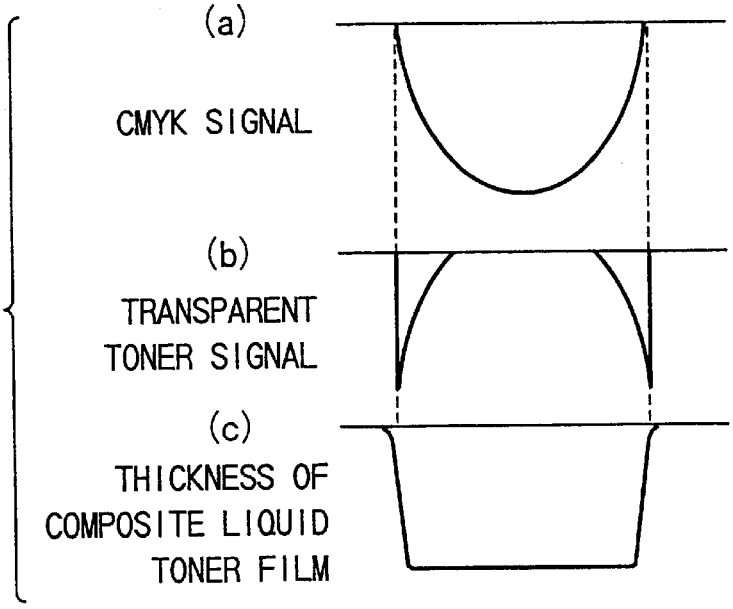
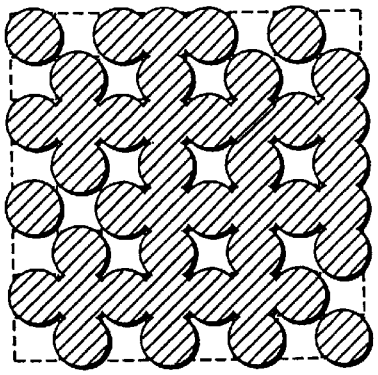
FIG. 7A
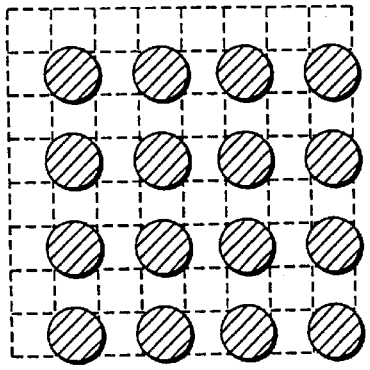
FIG. 7B
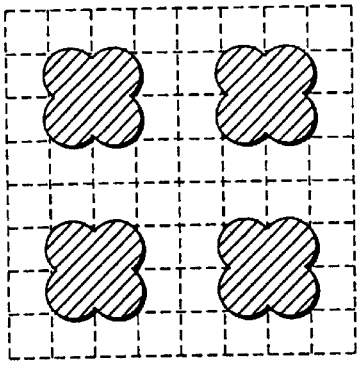
FIG. 7C

| | CONDITION | | | EXPERIMENTAL RESULT ON TRANSFER | | | |
|---|---|---|---|---|---|---|---|
| | | | | LOW-DENSITY PORTION | | HIGH-DENSITY PORTION | |
| | GLASS TRANSITION TEMPERATURE OF TONER | SURFACE TEMPERATURE OF PHOTOSENSITIVE BODY | TEMPERATURE OF INTERMEDIATE TRANSFER MEDIUM | TRANSFER EFFICIENCY | GRAININESS | DENSITY UNEVENNESS | TRANSFER EFFICIENCY |
| NO APPLICATION OF PRESENT INVENTION | 7℃ | 30℃ | 70℃ | 20% | × | × | 95% OR MORE |
| APPLICATION OF FIRST EMBODIMENT | 7℃ | 30℃ | 70℃ | 75% | △ | ○ | 95% OR MORE |
| APPLICATION OF SECOND EMBODIMENT | 7℃ | 30℃ | 70℃ | 20%～50% | ○ | △ | 95% OR MORE |
| APPLICATION OF THIRD EMBODIMENT | 7℃ | 30℃ | 70℃ | 95% OR MORE | ○ | ○ | 95% OR MORE |

FIG. 9

| | CONDITION | | | | | | | EXPERIMENTAL RESULT ON TRANSFER | | | |
|---|---|---|---|---|---|---|---|---|---|---|---|
| | | PRIMARY TRANSFER SECTION | | | SECONDARY TRANSFER SECTION | | | PRIMARY TRANSFER | | SECONDARY TRANSFER | |
| | GLASS TRANSITION TEMPERATURE OF TONER | SURFACE TEMPERATURE OF PHOTOSENSITIVE BODY | TEMPERATURE OF INTERMEDIATE TRANSFER MEDIUM | NIP WIDTH | TEMPERATURE OF INTERMEDIATE TRANSFER MEDIUM | TEMPERATURE OF PAPER SHEET | NIP WIDTH | TRANSFER RATE 300mm/s | TRANSFER RATE 400mm/s | TRANSFER RATE 300mm/s | TRANSFER RATE 400mm/s |
| ROLLER INTERMEDIATE TRANSFER MEDIUM | 45℃ | 30℃ | 30℃ | 10mm | 90℃ | 90℃ | 10mm | ○ | ○ | ○ | △ |
| | 45℃ | 30℃ | 60℃ | 10mm | 90℃ | 90℃ | 10mm | ○ | ○ | ○ | △ |
| | 45℃ | 30℃ | 90℃ | 10mm | 90℃ | 90℃ | 10mm | ○ | ○ | ○ | △ |
| | 45℃ | 45℃ | 45℃ | 10mm | 90℃ | 90℃ | 10mm | × | × | CANNOT BE EVALUATED | CANNOT BE EVALUATED |
| | 45℃ | 60℃ | 60℃ | 10mm | 90℃ | 90℃ | 10mm | × | × | CANNOT BE EVALUATED | CANNOT BE EVALUATED |
| | 45℃ | 60℃ | 90℃ | 10mm | 90℃ | 90℃ | 10mm | × | × | CANNOT BE EVALUATED | CANNOT BE EVALUATED |
| BELT INTERMEDIATE TRANSFER MEDIUM | 45℃ | 30℃ | 60℃ | 8mm | 90℃ | 90℃ | 16mm | ○ | ○ | ○ | ○ |
| | 45℃ | 30℃ | 60℃ | 5mm | 90℃ | 90℃ | 16mm | ○ | ○ | ○ | ○ |

FIG. 13

| | CONDITION | | | | | | EXPERIMENTAL RESULT ON TRANSFER | | | |
|---|---|---|---|---|---|---|---|---|---|---|
| | | | PRIMARY TRANSFER SECTION | | SECONDARY TRANSFER SECTION | | PRIMARY TRANSFER | | SECONDARY TRANSFER | |
| | GLASS TRANSITION TEMPERATURE OF FIRST TONER | GLASS TRANSITION TEMPERATURE OF SECOND TONER | SURFACE TEMPERATURE OF PHOTOSENSITIVE BODY | TEMPERATURE OF INTERMEDIATE TRANSFER MEDIUM | TEMPERATURE OF INTERMEDIATE TRANSFER MEDIUM | TEMPERATURE OF PAPER SHEET | TRANSFER RATE 300mm/s | TRANSFER RATE 400mm/s | TRANSFER RATE 300mm/s | TRANSFER RATE 400mm/s |
| PRIOR ART | 45℃ | 45℃ | 30℃ | 70℃ | 90℃ | 90℃ | ○ | ○ | ○ | △ |
| | 45℃ | 45℃ | 30℃ | 70℃ | 90℃ | 80℃ | ○ | ○ | △ | × |
| | 45℃ | 45℃ | 30℃ | 70℃ | 80℃ | 70℃ | ○ | ○ | × | × |
| PRESENT INVENTION | 45℃ | 7℃ | 30℃ | 70℃ | 90℃ | 90℃ | ○ | ○ | ○ | ○ |
| | 45℃ | 7℃ | 30℃ | 70℃ | 80℃ | 80℃ | ○ | ○ | ○ | ○ |
| | 45℃ | 7℃ | 30℃ | 70℃ | 70℃ | 70℃ | ○ | ○ | ○ | △ |

FIG. 19

| | CONDITION | | | | | | EXPERIMENTAL RESULT ON TRANSFER | | | |
|---|---|---|---|---|---|---|---|---|---|---|
| | | | | | | | PRIMARY TRANSFER | | SECONDARY TRANSFER | |
| | GLASS TRANSITION TEMPERATURE OF TRANSPARENT RESIN | GLASS TRANSITION TEMPERATURE OF TONER | PRIMARY TRANSFER SECTION: SURFACE TEMPERATURE OF PHOTOSENSITIVE BODY | PRIMARY TRANSFER SECTION: TEMPERATURE OF INTERMEDIATE TRANSFER MEDIUM | SECONDARY TRANSFER SECTION: TEMPERATURE OF INTERMEDIATE TRANSFER MEDIUM | SECONDARY TRANSFER SECTION: TEMPERATURE OF PAPER SHEET | TRANSFER RATE 300mm/s | TRANSFER RATE 400mm/s | TRANSFER RATE 300mm/s | TRANSFER RATE 400mm/s |
| PRIOR ART | NO TRANSPARENT RESIN | 45℃ | 30℃ | 70℃ | 80℃ | 80℃ | ○ | ○ | △ | × |
| PRESENT INVENTION ONE (INTERMEDIATE TRANSFER MEDIUM) | 45℃ | 7℃ | 30℃ | 70℃ | 70℃ | 70℃ | ○ | ○ | ○ | ○ |

FIG. 21

| | CONDITION | | | | | | | | EXPERIMENTAL RESULT ON TRANSFER | |
|---|---|---|---|---|---|---|---|---|---|---|
| | | | PRIMARY TRANSFER SECTION | | SECONDARY TRANSFER SECTION | | TERTIARY TRANSFER | | TERTIARY TRANSFER | |
| | GLASS TRANSITION TEMPERATURE OF TRANSPARENT RESIN | GLASS TRANSITION TEMPERATURE OF TONER | SURFACE TEMPERATURE OF PHOTOSENSITIVE BODY | TEMPERATURE OF FIRST INTERMEDIATE TRANSFER MEDIUM | TEMPERATURE OF FIRST INTERMEDIATE TRANSFER MEDIUM | TEMPERATURE OF SECOND INTERMEDIATE TRANSFER MEDIUM | TEMPERATURE OF SECOND INTERMEDIATE TRANSFER MEDIUM | TEMPERATURE OF PAPER SHEET | TRANSFER RATE 300mm/s | TRANSFER RATE 400mm/s |
| PRESENT INVENTION (TWO INTERMEDIATE TRANSFER MEDIA) | 45℃ | 7℃ | 30℃ | 30～40℃ | 80℃ | 80℃ | 80℃ | 80℃ | ○ | ○ |
| | 45℃ | 7℃ | 30℃ | 30℃ | 70℃ | 70℃ | 70℃ | 70℃ | ○ | ○ |
| PRIOR ART | NO TRANSPARENT RESIN | 7℃ | 30℃ | 30℃ | 70℃ | 70℃ | 70℃ | 70℃ | ○ | ○ |

FIG. 23

IMAGE FORMING APPARATUS HAVING HEATING AND COOLING UNITS

CROSS-REFERENCE TO RELATED APPLICATIONS

This application is based upon and claims the benefit of priority from the prior Japanese Patent Application No. 11-269265, filed Sep. 22, 1999, the entire contents of which are incorporated herein by reference.

BACKGROUND OF THE INVENTION

The present invention relates to an image forming apparatus and, more particularly, an image forming apparatus for forming an image on an image formation medium by using liquid toner.

Image forming apparatuses using liquid toner have advantages over, for example, dry type apparatuses such as electrophotographic apparatuses and electrostatic recording apparatuses. Merits of such apparatuses have come to be redeemed. For example, the main merits of these apparatuses are that high image quality can be realized because fine liquid toner of the order of submicron size can be used, economical operation can be realized because sufficient image density can be obtained with a small amount of liquid toner, and near-typeset-quality texture can be obtained.

On the other hand, conventional image forming apparatuses using liquid toner have suffered several problems, and hence have allowed the dry type techniques to dominate the market for a long period of time. One of these problems is associated with a transfer means.

The first problem in transfer is that the image quality is poor. More specifically, according to a conventional technique, as a transfer means directly transfers liquid toner adhering to an image carrier onto a paper sheet by using an electric field, transfer unevenness is caused by electric field variations corresponding to unevenness on the surface of the paper sheet. In addition, a transfer failure tends to occur due to variations in the electric characteristics of the paper sheet, environment dependency, and the like, resulting in a considerable deterioration in the image quality of the transferred image.

In order to solve such a problem, an apparatus has been proposed, which temporarily transfers an electrostatic latent image from an image carrier onto an intermediate transfer medium and then transfers it from the intermediate transfer medium onto a paper sheet. Apparatuses for transferring an electrostatic latent image from an image carrier onto an intermediate transfer medium by using en electric field and then transferring it from the intermediate transfer medium onto a paper sheet by using pressure (and heat) are disclosed in, for example, U.S. Pat. Nos. 5,148,222, 5,166,734, and 5,208,637.

In this case, since it is relatively easy to make an intermediate transfer medium by using a material having a smooth surface and exhibiting little fluctuations and variations in electric resistance, a deterioration in image quality due to transfer can be reduced. However, a transfer efficiency of 100% cannot be achieved. In addition, since electric field transfer uses electrophoresis, a large amount of solvent must be left in a liquid toner image (visible image) in a transfer process. This solvent moves to the intermediate transfer medium and evaporates due to heat, and hence a large amount of solvent vapor is generated.

Apparatuses which use pressure (and heat) for both transfer onto an intermediate transfer medium and transfer onto a paper sheet are disclosed in Jpn. Pat. Appln. KOKOKU Publication No. 46-41679 and Jpn. Pat. Appln. KOKAI Publication No. 62-280882. In many cases, since the great part of the solvent in a liquid toner image must be evaporated almost completely before primary transfer onto an intermediate transfer medium, the solvent after development is squeezed out. As a consequence, the amount of solvent vapor generated decreases.

If, however, pressure (and heat) is used for both transfer onto an intermediate transfer medium and transfer onto a paper sheet, the releasability (surface energy) of the intermediate transfer medium and photosensitive body is difficult to adjust. According to an experiment, both transfer processes cannot be satisfactorily performed unless the surface energy of the intermediate transfer medium is set to about 30 to 35 dyne/cm and a release layer with 30 dyne/cm or less is formed on the surface of the photosensitive body. It is especially difficult to perform transfer onto paper with poor smoothness, e.g., PPC paper. If, therefore, a sufficient transfer efficiency is to be obtained, transfer onto the intermediate transfer medium becomes unstable.

As a technique of solving such a problem, a transfer scheme is available, which uses an intermediate transfer medium which is an elastic member having relatively low surface energy and has tack on its surface. In a primary transfer process, a liquid toner image on a photosensitive body is transferred onto the intermediate transfer medium by using the tack strength (slight adhesive strength) between the intermediate transfer medium and liquid toner. In a secondary transfer process, the releasability of the intermediate transfer medium is mainly used to transfer the image onto a paper sheet using pressure and heat.

In primary transfer using the above tack, the state of a liquid toner layer on an image carrier (photosensitive body) is very important. More specifically, while the liquid toner is completely dissolved, the liquid toner layer becomes a uniform film, and particles retain nothing of their original form. When the temperature of the surface of the photosensitive body is equal to or higher than the glass transition temperature ($T_g$) of liquid toner, in particular, the liquid toner completely becomes filmy.

Under this condition, the thinner the liquid toner layer formed on the photosensitive body is, the more difficult primary transfer is. This is because as the liquid toner layer becomes thinner, the tack of the layer as a film is lost. In fact, since the particle size of a pigment dispersed in a resin is about 0.05 to 0.2 $\mu$m, when the overall thickness of the liquid toner layer becomes 0.2 $\mu$m or less, the pigment without tack takes the form of pillars in the direction of thickness. As a consequence, it is difficult for the entire film to obtain an elastic effect. According to an experiment, when the thickness of the liquid toner layer becomes less than 0.2 $\mu$m, the primary transfer efficiency abruptly decreases. As described above, in the conventional apparatuses, since thin liquid toner layer portions are formed, it is difficult to attain image quality at a certain level or more.

BRIEF SUMMARY OF THE INVENTION

It is an object of the present invention to provide an image forming apparatus which can form a high-quality image by stably performing proper transfer even when the liquid toner layer on an image carrier is thin, and can also reduce power consumption.

According to the present invention, there is provided an image forming apparatus comprising determination means for determining whether the supplied image signal is an image signal that makes a liquid toner film have a thickness not more than a predetermined value, image processing means for performing predetermined processing for the image signal and outputting a processed image signal when the determination means determines that the supplied image signal is an image signal that makes the liquid toner film have a thickness not more than the predetermined value, electrostatic latent image forming means for forming an electrostatic latent image on the image carrier by irradiating the image carrier with a light from exposure means on the basis of the processed image signal output from the image processing means, developing means for developing the image on the image carrier by using the liquid toner in accordance with the electrostatic latent image formed on the image carrier by the electrostatic latent image forming means, and transfer means for transferring the image on the image carrier, developed by the developing means, onto the recording medium.

In the image forming apparatus of the present invention, according to the above features, whether an image signal is likely to generate a low-density image portion is checked by comparing the image signal with data such as data in a table in the image processing section. If it is determined that a low-density image portion is likely to be generated, signal processing is performed to remove this low-density image portion by, for example, amplifying the signal or combining separate pulse signals. This prevents the generation of a low-density image portion, which is generated when an image is formed by using liquid toner in the prior art, thus providing an image forming apparatus which can form a high-quality image without any loss or the like.

A method of removing a low-density image portion resulting from this liquid toner is not limited to this. For example, such a portion can also be removed by additionally applying a transparent resin liquid toner or controlling the temperatures of the image forming apparatus or intermediate transfer medium in consideration of the glass transition temperature of liquid toner.

According to these various embodiments as well, image forming apparatuses which can form high-quality images by using liquid toner can be provided.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principle of the invention.

FIGS. 6A and 6B are timing charts for explaining pulse width modulation associated with the thickness of a liquid toner layer in each embodiment;

FIGS. 7A, 7B, and 7C are views for explaining the arrangements of pixels in low-density image portions in each embodiment;

FIG. 9 is a view showing a summary of experimental results in the first, second, and third embodiments;

FIG. 13 is a view showing a summary of experimental results in the fifth embodiment;

FIG. 19 is a view showing experimental results in the sixth embodiment;

FIG. 21 is a view showing experimental results in the seventh embodiment;

FIG. 23 is a view showing experimental results in the eighth embodiment.

DETAILED DESCRIPTION OF THE INVENTION

A plurality of embodiments of the present invention will be described in detail below with reference to the views of the accompanying drawing.

<<Structure of Digital Copying Machine According to Present Invention>>

Figure 1:
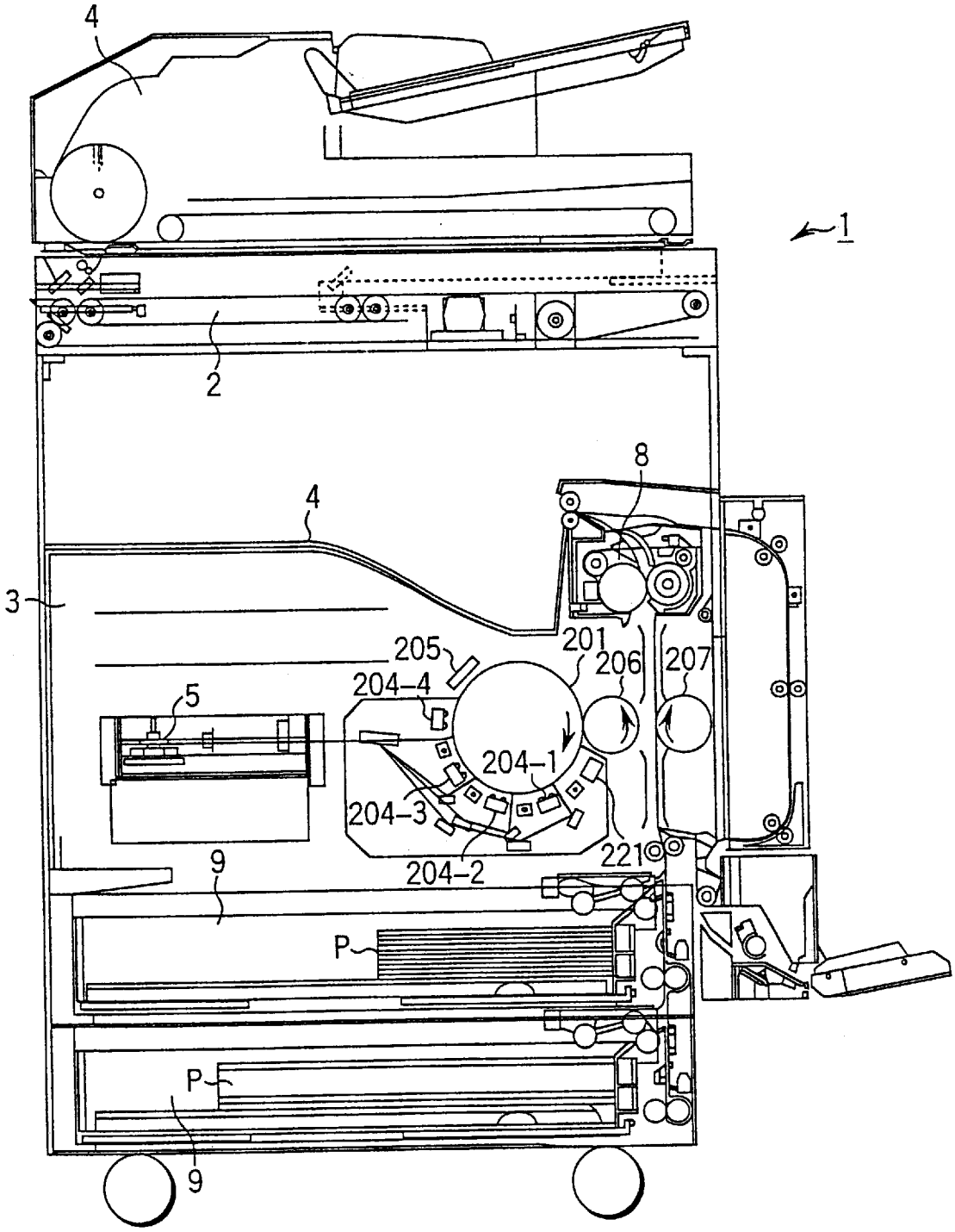
FIG. 1 is a sectional view of an image forming apparatus using liquid toner according to the present invention.

FIG. 1 is a sectional view showing the structure of a digital copying machine using liquid toner. As shown in FIG. 1, a digital copying machine 1 is comprised of a scanner 2 for generating an image signal by reading the image information of a copy target as light and dark patterns and an image forming section 3 for forming an image corresponding to an image signal supplied from the scanner 2 or an external unit. Note that an automatic document feeder (ADF) 4 is integrally mounted on the scanner 2. When copy targets take the form of sheets, the ADF 4 sequentially exchanges copy targets in synchronism with image read operation by the scanner 2.

In brief, the image forming section 3 includes an exposure unit 5 for outputting a light from exposure means corresponding to image information supplied from the scanner 2 or an external unit, a photosensitive drum 201 on which an electrostatic latent image corresponding to the laser beam from the exposure unit 5 is formed, developing units 204-1 to 204-4 for supplying liquid toner in accordance with the electrostatic latent image formed on the photosensitive drum 201 to develop it, and an image is obtained when the liquid toner images on the photosensitive drum 201, developed by the developing units 204-1 to 204-4, are transferred and fixed simultaneously onto a paper sheet P that was conveyed from a paper convey unit 9 and passed through between an intermediate transfer medium 206 and final transfer member 207 disposed to be adjacent to the photosensitive drum 201, and the like. More, if necessary, a fixing unit 8 may be provided for improving the degree of the gloss and the fixing of the image, in the lower reaches of the image stream. The developing units 204-1 to 204-4, a cleaner 221, a dryer 205, and the like are disposed around the photosensitive drum 201.

When image information is supplied from the scanner 2 or an external unit, the exposure unit 5 irradiates the photosensitive drum 201 with a light from exposure means intensity-modulated in accordance with the image information. As a consequence, a liquid toner image corresponding to the image to be copied is formed on the photosensitive drum 201.

The electrostatic latent image formed on the photosensitive drum 201 is developed when the developing units 204-1 to 204-4 selectively supply liquid toner thereto. The liquid toner image formed on the surface of the photosensitive drum 201 is temporarily transferred onto the intermediate transfer medium 206. The paper sheets P as transfer media are picked up by a pickup roller one by one from a paper cassette 9 and conveyed along a convey path extending between the intermediate transfer medium 206 and the final transfer member 207. The paper sheet P is then timed with the liquid toner image on the intermediate transfer medium 206 by an aligning roller for aligning the paper sheet P with the liquid toner image formed on the intermediate transfer medium 206, and supplied (to the transfer position), at which the liquid toner image is transcribed and fixed simultaneously onto the paper sheet P.

The liquid toner transcribed on the paper sheet P is transferred, in this embodiment for improving the degree of the gloss and the fixing of the image, to a fixing unit 108, and the liquid toner would be fixed on the paper sheet P, however, this operation is not always necessary.

The paper sheet P on which the image formed by the liquid toner is fixed by the fixing unit 108 is discharged by paper discharge rollers to a discharge space (paper discharge tray) between the scanner 2 and the paper cassette 9.

Figure 2:
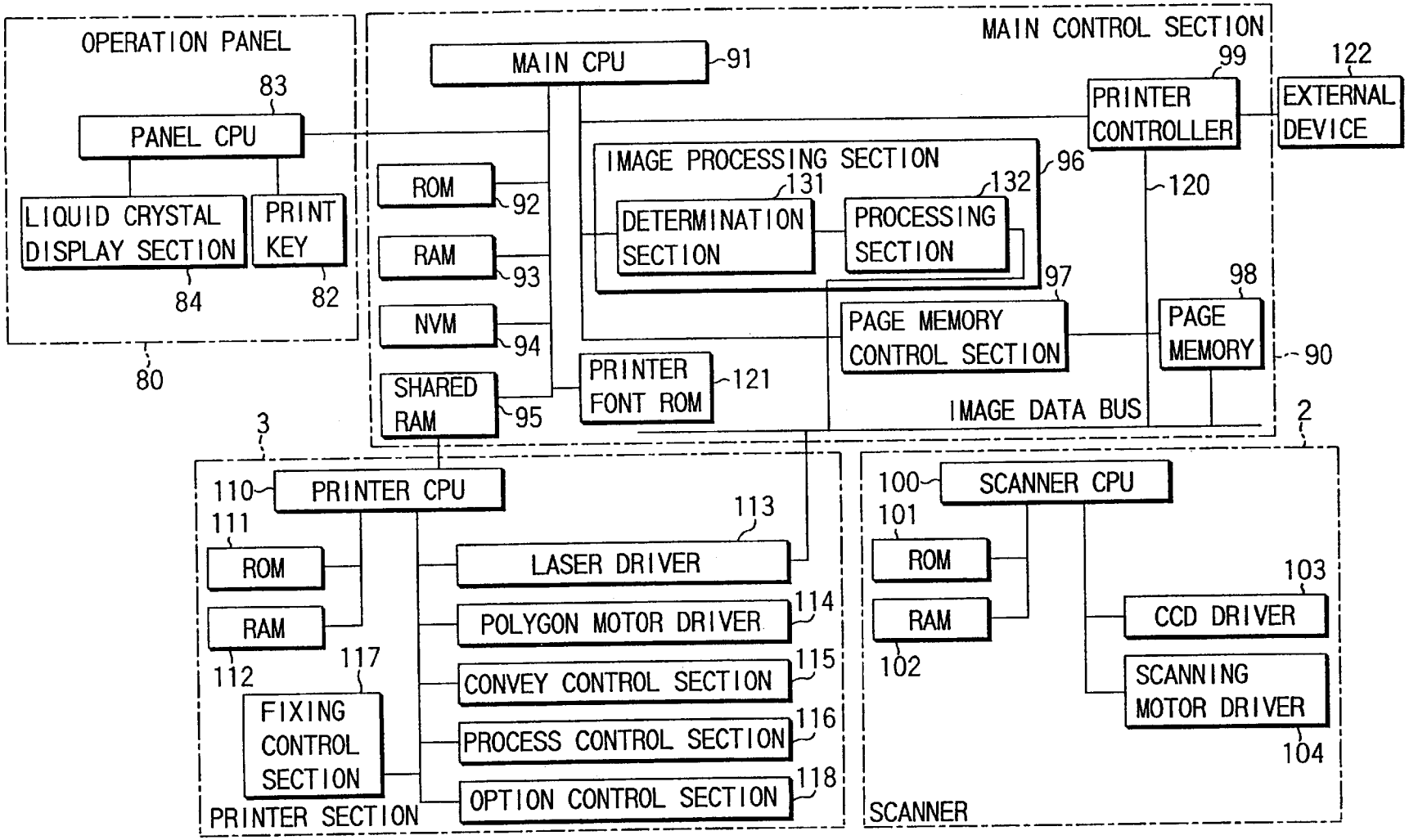
FIG. 2 is a block diagram showing the image forming apparatus using liquid toner according to the present invention.

FIG. 2 is a block diagram schematically showing electrical connection in the digital copying machine shown in FIG. 1 and the flows of signals for control. Referring to FIG. 2, a control system is comprised of three CPUs (Central Processing Units), i.e., a main CPU 91 in a main control section 90, a scanner CPU 100 for the scanner 2, and a printer CPU 110 for the image forming section 3.

The main CPU 91 performs two-way communication with the printer CPU 110 through a shared RAM 95. The main CPU 91 outputs an operation instruction, and the printer CPU 110 returns a status signal. The printer CPU 110 serially communicates with the scanner CPU 100. The printer CPU 110 outputs an operation command, and the scanner CPU 100 returns a status signal.

An operation panel 80 has various operation keys 81, a liquid crystal display section 82, and a panel CPU 83 to which these components are connected. The operation panel 80 is connected to the main CPU 91.

The main control section 90 is comprised of the main CPU 91, a ROM 92, a RAM 93, a NVRAM 94, the shared RAM 95, an image processing section 96, a page memory 98, a printer controller 99, and a printer font ROM 121.

The main CPU 91 controls the overall machine. Control programs and the like are stored in the ROM 92. The RAM 93 is used to temporarily store data. The NVRAM (nonvolatile RAM) 94 is a nonvolatile memory backed up by a battery (not shown) and holds stored data even after power-down. The shared RAM 95 is used for two-way communication between the main CPU 91 and the printer CPU 110. The page memory control section 97 stores and reads out image information in and from the page memory 98. The page memory 98 has an area in which image information corresponding to a plurality of pages can be stored, and is configured to store data obtained by compressing image information from the scanner 2 in units of pages.

In the printer font ROM 121, font data corresponding to print data is stored. The printer controller 99 expands print data from an external device 122 such as a personal computer into image data with a resolution corresponding to resolution data assigned to the print data by using the font data stored in the printer font ROM 121.

The scanner 2 is comprised of, for example, the scanner CPU 100 for performing overall control, a ROM 101 in which control programs and the like are stored, a RAM 102 for storing data, a CCD driver 103 for driving a line sensor 34, and a scanning motor driver 104 for controlling the rotation of a scanning motor for moving an exposure lamp 25, mirrors 26, 27, and 28, and the like.

The image forming section 3 is comprised of the printer CPU 110 for performing overall control, a ROM 111 in which control programs and the like are stored, a RAM 112 for storing data, a laser driver 113 for driving a semiconductor laser oscillator, a polygon motor driver 114 for driving a polygon motor for the exposure unit 5, a convey control section 115 for controlling the conveyance of the paper sheet P along the convey path, a process control section 116 for controlling charging, developing, and transfer processes performed by using the developing units 204-1 to 204-4, transfer chargers 202-1 to 202-4, and the like, a fixing control section 117 for controlling the fixing unit 8, an option control section 118 for controlling options, and the like.

Note that the image processing section 96, page memory 98, printer controller 99, and laser driver 113 are connected to each other through an image data bus 120.

The image processing section 96 variously processes image data obtained by reading an original with the scanner 2. As processes associated with the present invention, a process performed by a determination section 131 for detecting a low-density image portion, a process performed by a processing section 132 for removing this portion or converting it into a high-density image, and the like are presented.

<<First Embodiment>>

The first embodiment of the present invention will be described below with reference to the views of the accompanying drawing.

According to the first embodiment, in order to solve the problem of a deterioration in image quality which is posed in an image forming apparatus using liquid toner, there is provided an image forming apparatus which detects a low-density image portion from an image signal and converting it into a high-density image.

Figure 3:
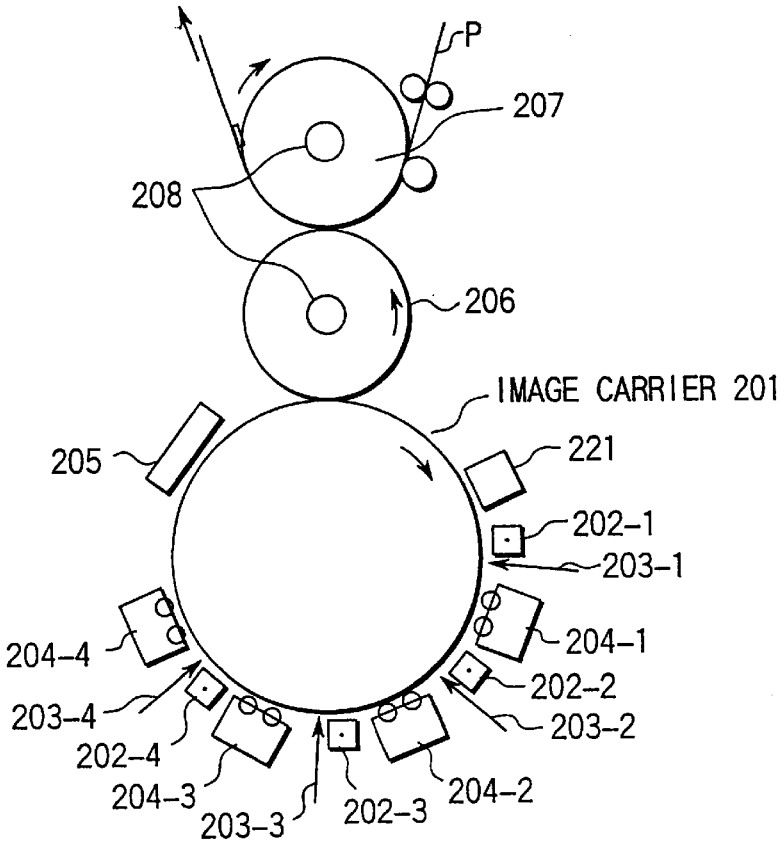
FIG. 3 is a view showing the arrangement of the main part of the first and second embodiments of the present invention.

FIG. 3 shows the arrangement of part of an image forming section 3 of the image forming apparatus using liquid toner according to the present invention.

A photosensitive drum 201 is an image carrier that rotates in the direction indicated by the arrow in FIG. 3. The image carrier 201 has an organic or amorphous silicon photosensitive layer formed on a conductive substrate. A cleaner 221, charger 202-1, developing unit (developing means) 204-1, charger 202-2, developing unit (developing means) 204-2, charger 202-3, developing unit (developing means) 204-3, charger 202-4, developing unit (developing means) 204-4, and pre-transfer drying means 205 are sequentially arranged around the image carrier 201 along the rotating direction of the image carrier 201.

An area on the surface of the image carrier 201, located between the charger 202-1 and the developing unit 204-1, is irradiated with laser exposure light 203-1 based on an image-modulated laser beam from a laser generating unit (electrostatic latent image forming means). An area between the charger 202-2 and the developing unit 204-2 is irradiated with laser exposure light 203-2 based on an image-modulated laser beam from a laser generating unit (electrostatic latent image forming means). An area between the charger 202-3 and the developing unit 204-3 is irradiated with laser exposure light 203-3 based on an image-modulated laser beam from a laser generating unit (electrostatic latent image forming means). An area between the charger 202-4 and the developing unit 204-4 is irradiated with laser exposure light 203-4 based on an image-modulated laser beam from a laser generating unit (electrostatic latent image forming means).

The outer surface of an intermediate transfer medium 206 serving as a first transfer means comes into contact with the outer surface of the image carrier 201 at a position located downstream from the pre-transfer drying means 205 in the rotating direction. A final transfer member 207 serving as a second transfer means is disposed on the outer surface of the intermediate transfer medium 206 at a position opposite to the image carrier 201. A transfer medium, e.g., a paper sheet P, is fed between the final transfer member 207 and the intermediate transfer medium 206 at a predetermined timing. The intermediate transfer medium 206 and final transfer member 207 incorporate heating means 208.

The image carrier 201 is a photosensitive drum having an organic or amorphous silicon photosensitive layer formed on a conductive substrate. The image carrier 201 is uniformly charged by the known corona charger or Scorotron charger 202-1, and then irradiated with the laser exposure light 203-1 based on the image-modulated laser beam, thereby forming an electrostatic latent image on the surface of the image carrier 201. Thereafter, the developing unit 204-1, which contains liquid toner, supplies liquid toner to the surface of the image carrier 201 to develop the electrostatic latent image on the image carrier 201, thus forming a visible image.

The liquid toner is obtained by, for example, dispersing an acrylic resin or the like which has a glass transition temperature ($T_g$) in the range of −50° C. to 70° C. and is doped with a metal soap for charge control and a pigment into a hydrocarbon-based insulating solvent such as Isopar.TM. G, Isopar.TM. L, Isopar.TM. M, Norpar.TM. 12, Norpar.TM. 13, or Norpar.TM. 15 available from Exxon Corporation.

The liquid toner adhering to the electrostatic latent image may reach the pre-transfer drying means 205, at which the solvent is almost dried, and may be primarily transferred onto the intermediate transfer medium 206. In this case, however, a second electrostatic latent image is consecutively formed by the charger 202-2 and laser exposure light 203-2 and developed by the developing unit 204-2 containing a second liquid toner of a color different from that of the liquid toner contained in the developing unit 204-1. After this second development, a two-color visible image is formed on the image carrier 201.

Likewise, third and fourth charging, exposure, and development processes are performed by the charger 202-3 and laser exposure light 203-3, and the charger 202-4 and laser exposure light 203-4 as well. As a consequence, a full-color visible image (liquid toner. image) is formed on the image carrier 201.

The visible image formed in this manner is almost dried by the drying means 205 and transferred onto the intermediate transfer medium 206. A paper sheet P is fed between the intermediate transfer medium 206 and the final transfer member 207 in synchronism with the rotation of the intermediate transfer medium 206. The paper sheet P is then pressed (and heated) by the intermediate transfer medium 206 and final transfer member 207. As a consequence, the visible image on the intermediate transfer medium 206 is transferred onto the paper sheet P.

The intermediate transfer medium 206 is formed by coating a metal roller with silicone rubber or urethane rubber having a thickness of 0.1 to 5 mm. The surface hardness of the intermediate transfer medium 206 is 1 to 70° (JIS-A).

The photosensitive layer on the image carrier 201 is coated with a silicone- or fluorine-based release layer having a thickness of 0.1 to 5 $\mu$m. The surface energy of the release layer is 15 to 30 dyne/cm when calculated from the measurement value based on the contact angle between Isopar.TM. L and pure water. The lower the surface energy of the image carrier 201, the more advantageous for first transcription, however, it has limitation for taking into consideration of the state of image forming. Thereupon, it is possible to regulate the tack of the intermediate transfer medium and the condition of the transcription, thereby it goes over this range and so as to realize suitable transcription.

In this state, development was performed while a resin was selected to make the glass transition temperature $T_g$ of liquid toner fall within the range of about −20° C. to 20° C., and the temperature of the release layer on the photosensitive layer was kept at 21° C. or more. As resins used to form liquid toner, some of lauryl methacrylate, lauryl acrylate, acrylic acid, stearyl methacrylate, stearyl acrylate, butyl methacrylate, butyl acrylate, ethyl methacrylate, ethyl acrylate, methyl methacrylate, methyl acrylate, vinyl acetate, and styrene were selected and combined to prepare acryl-ester-based copolymers having different glass transition temperatures $T_g$. These resins, dispersants, and the like were added to Isopar.TM. L, and these components were mixed/dispersed in the presence of glass beads by using a paint shaker, thus forming concentrated liquid toners. Each obtained concentrated liquid toner was diluted with Isopar.TM. L to a nonvolatile solid content of 1 wt %. In addition, 50 wt % of zirconium naphthenate available from DAINIPPON INK & CHEMICALS, INC. (nonvolatile solid concentration: 49 wt %) were added to the nonvolatile solid of each liquid toner described above, thus obtaining final liquid toner.

As a pigment to be added to particles of each liquid toner, e.g., cyan liquid toner, cyanine blue KRO available from SANYO COLOR WORKS, LTD. was used. The weight ratio between the resin and the pigment was 4:1.

In this manner, liquid toners in each of which liquid toner particles were dispersed, with the glass transition temperature $T_g$ in a dry state being controlled, were prepared. Note that this glass transition temperature $T_g$ was measured by using EXSTAR6000DSC available from SEIKO ELEC- TRIC CO., LTD. When two or more signals were observed, a signal representing a higher temperature was used as a signal representing the glass transition temperature Tg.

In the experiment, the glass transition temperature of each liquid toner was set to 7° C. the temperature of the release layer on the photosensitive layer was set to room temperature (20 to 30° C.), and the pre-transfer drying means 205 blew warm air of 50° C. on the liquid toner image and image carrier 201 to almost dry the liquid toner image. In the subsequent primary transfer, with regard to an image having a liquid toner layer thickness of 0.2 $\mu$m or more, the liquid toner image could be properly transferred onto the surface of the intermediate transfer medium 206 at a transfer rate of 50 to 400 mm/sec.

This transfer is probably accomplished by the releasability of the surface of photosensitive layer and the tack of the intermediate transfer medium 206 and liquid toner layer. If, therefore, a medium with relatively strong tack is used as the intermediate transfer medium 206, proper transfer can be performed without heating the intermediate transfer medium 206. With regard to pressure, a linear pressure of about 0.1 to 20 kg/cm is preferably applied on the image carrier 201 in the longitudinal direction.

The visible image transferred on the intermediate transfer medium 206 is secondarily transferred onto the surface of the paper sheet P by the final transfer member 207. At this time, the final transfer member 207 and intermediate transfer medium 206 have been heated to 40 to 200° C. by the heating means 208.

The visible image on the intermediate transfer medium 206 reaches the secondary transfer area in a heated state, and the paper sheet P is clamped between the intermediate transfer medium 206 and the final transfer member 207 to receive a load equivalent to a linear pressure of 0.2 to 20 kg/cm in the longitudinal direction. As a consequence, the visible image is transferred and fixed simultaneously onto the paper sheet P. In the experiment, since liquid toner with a low glass transition temperature $T_g$ was used, a transfer efficiency of nearly 100% could be accomplished at a transfer rate of 400 mm/sec when the temperature in this secondary transfer process was 70° C.

Figure 4:
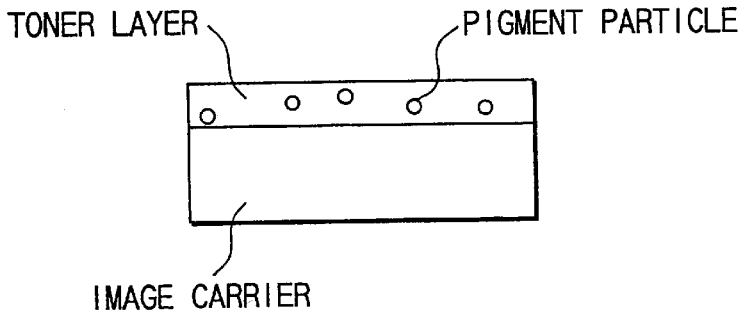
FIG. 4 is a sectional view for explaining the formation of a liquid toner layer in each embodiment.
Figure 5:
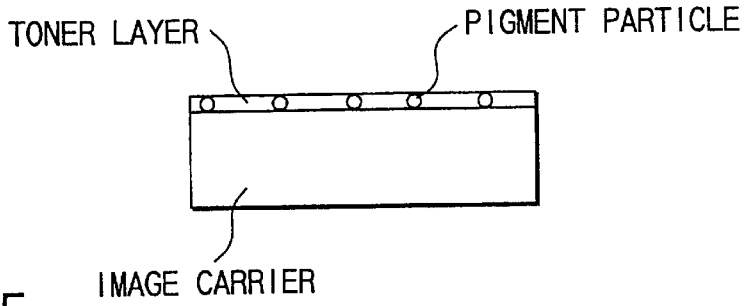
FIG. 5 is a sectional view for explaining the formation of a liquid toner layer in each embodiment.

In this arrangement, the liquid toner layer on the image carrier 201 before primary transfer would be a thickness of about 0.5 $\mu$m and perfectly forms a film, as shown in FIG. 4. When the thickness of the liquid toner layer decreases to less than 0.2 $\mu$m, pigment particles having no tack take the form of pillars, exceeding the thickness of the liquid toner layer, as shown in FIG. 5. As a result, the liquid toner layer cannot properly exhibit elasticity in the direction of thickness, and loses tack. For this reason, primary transfer becomes abruptly unstable.

In this embodiment, in order to solve the problem of a considerable deterioration in image quality due to a decrease in the thickness of a liquid toner layer, laser exposure is controlled to decrease the resolution of a low-density image portion at the time of the formation of an electrostatic latent image by the laser exposure 203-1 to laser exposure 203-4 in consideration of a case wherein the surface temperature of the image carrier 201 becomes equal to or higher than the glass transition temperature $T_g$ of the liquid toner in an area corresponding to the intermediate transfer medium 206.

More specifically, laser exposure is performed so as not to form any low-density image portion by decreasing the resolution in laser exposure operation with respect to only a low-density image portion in which the liquid toner layer is likely to become thin, thereby minimizing a portion in which the liquid toner layer becomes thin (less than 0.2 $\mu$m) as compared with a case of normal control.

Figure 6A:
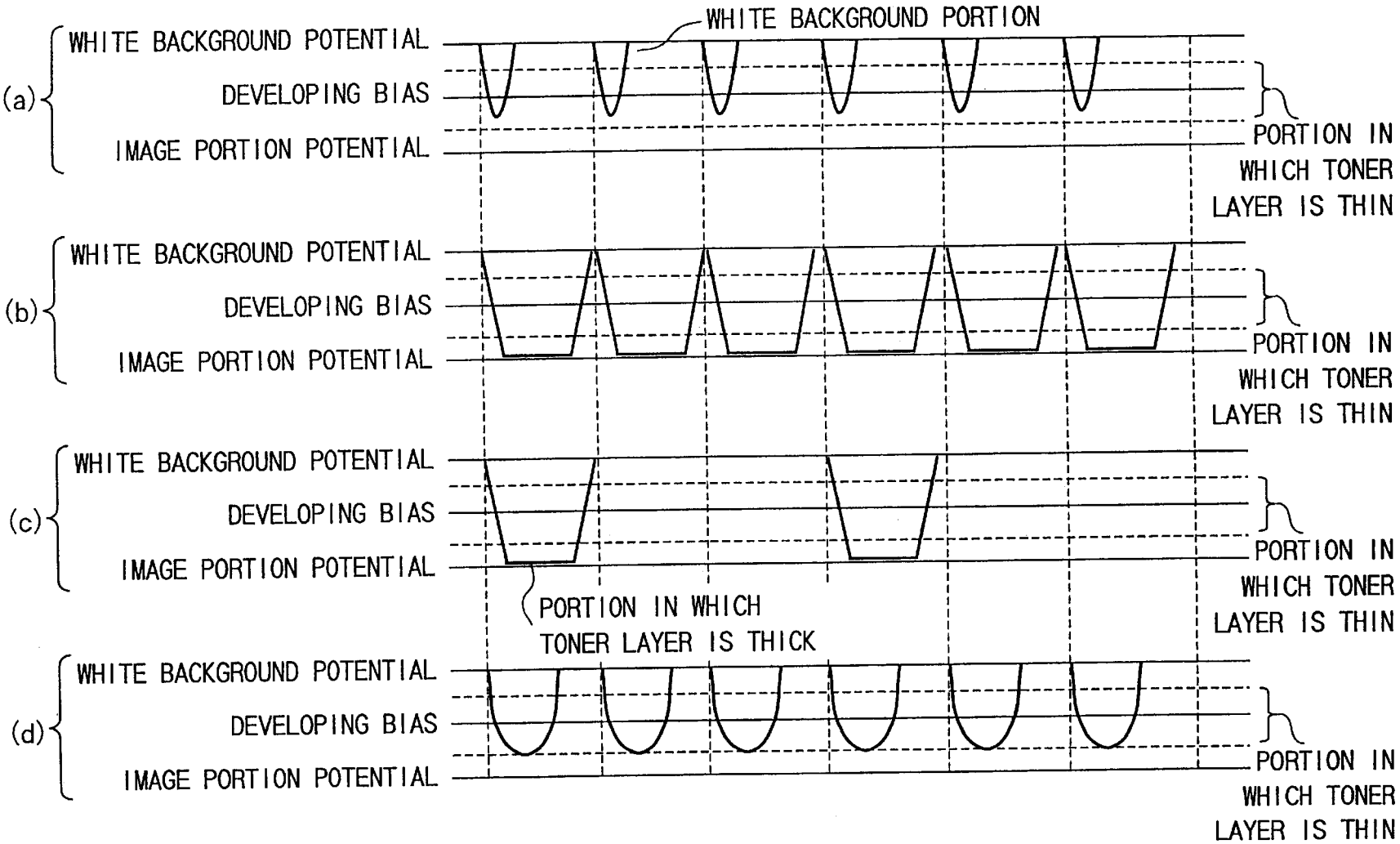

If a laser optical system uses a pulse width modulation scheme for laser emission in a laser exposure process, since the pulse width in a low-density image portion is short, the surface potential of the photosensitive body may not reach the image portion potential in some case, as indicated by (a) in FIG. 6A. Obviously, the degree of this phenomenon is greatly influenced by the process speed and the performance of an optical system. In general, as the pulse width increases, the ratio of the image portion potential to the total image area increases. As the pulse width decreases in a low-density image portion, the ratio of the image portion potential decreases, and the ratio of halftone potentials increases. A case of a long pulse width is indicated by (b) in FIG. 6A.

A halftone potential of the photosensitive body corresponds to an area between an image portion and a non-image portion. At this potential, a liquid toner layer thinner than that in a solid image area is developed. That is, in a general laser exposure scheme based on pulse width modulation, as the density of an image decreases, the ratio of the thin liquid toner layer portion to the total image area increases.

Assume that the liquid toner layer of a monochrome solid image has a thickness of about 0.5 $\mu$m. In this case, if an area of 0.2 $\mu$m or less cannot be transferred, the transfer loss increases in an image area with lower density. As a result, the transferred image becomes higher in contrast than the visible image before primary transfer.

In a low-density image area, therefore, the pulse width is not decreased, and the pixel size is not decreased, as indicated by (c) in FIG. 6A, to decrease the number of pixels per unit area, thereby decreasing the image density without greatly changing the ratio of the thin liquid toner layer portion to the image area. With the use of this scheme, since in an area where the image density is low, the ratio of the thin liquid toner layer portion does not greatly change, stable tone reproduction can be implemented.

Such electrical signal conversion processing is performed by an image processing section 96 in FIG. 2. More specifically, in a determination section 131, a table or the like is prepared to detect a signal representing a low-density image area that requires signal conversion processing. An image signal is compared with this table to detect a signal that is likely to generate a low-density image area (e.g., the signal indicated by (a) in FIG. 6A). When such a signal is detected, a processing section 132 converts the signal into a signal that does not generate a low-density image area (e.g., the signal indicated by (c) in FIG. 6A). This signal processing prevents the laser beams 203-1 to 203-4 based on a signal that generates a low-density image from being supplied to the exposure unit 5. This makes it possible to solve the problem of a deterioration in image quality in the use of liquid toner.

Assume that the present invention is to be executed in a multicolor machine. In this case, even if, for example, a given color image is a low-density image, the above signal conversion need not be performed as long as another color image to be overlaid on this color image is a high-density image, and the image obtained by overlaying the two images becomes a high-density image. In performing multicolor processing, the necessity of the above signal conversion processing is determined by checking whether the image obtained by overlaying two color images becomes a high-density image or low-density image.

When the laser exposure scheme is a binary scheme, an area where the liquid toner layer is thin increases in a low-density image portion in which adjacent pixels are located far from each other. FIGS. 7A, 7B, and 7C are schematic views for explaining such a state, in which liquid toner images are viewed from above. FIG. 7A shows an image in which the dot area ratio is 60% or more. In this image, pixels interfere and join with each other in portions where the intervals between pixels are small, resulting in a thick liquid toner layer. If, however, the area ratio becomes 25% or less as shown in FIG. 7B, since pixels are located far from each other, the ratio of the thin liquid toner layer portion to the image portion area increases as compared with the former case.

In order to prevent such a problem, as in the above case, in a determination section 131 in the image processing section 96 in FIG. 2, a table or the like is prepared to detect a signal like the one shown in FIG. 7B, which represents a low-density image area that requires signal conversion processing. An image signal is compared with this table to detect a signal that is likely to generate a low-density image area (e.g., the signal shown in FIG. 7B). When such a signal is detected, a processing section 132 converts the signal into a signal that does not generate a low-density image area (e.g., the signal shown in FIG. 7C). As shown in FIG. 7C, if the pixel size is substantially increased to partly decrease the intervals between adjacent pixels, since the thin liquid toner area does not excessively increase even in a low-density image portion, primary transfer can be properly performed. In this manner, signal conversion is performed every time a signal that requires signal conversion is detected. With this operation, the laser beams 203-1 to 203-4 based on a signal that generates a low-density image are not supplied to the exposure unit 5. This makes it possible to provide an image forming apparatus which can solve the problem of a deterioration in image quality in the use of liquid toner.

<<Second Embodiment>>

According to the second embodiment, there is provided an image forming apparatus using liquid toner, which removes any low-density image portion by increasing the area ratio of a pulse signal as an image signal at a predetermined amplification factor with respect to a low-density image portion in which the toner film is thin.

Such processing of doubling the area ratio of a pulse signal is performed as electrical signal conversion processing by an image processing section 96 in FIG. 2. In a determination section 131, a table or the like is prepared to detect a signal representing a low-density image area that requires signal conversion processing. An image signal is compared with this table to detect a signal that is likely to generate a low-density image area (e.g., the signal indicated by (a) in FIG. 6A). When such a signal is detected, a processing section 132 increases the area ratio of this signal at a predetermined amplification factor, thus performing signal conversion (to the signal indicated by (d) in FIG. 6A). With this signal processing, laser beams 203-1 to 203-4 based on a signal that generates a low-density image are not supplied to an exposure unit 5, thereby solving the problem of a deterioration in image quality in the use of liquid toner. With this processing, although the transfer residue on an image carrier 201 increases in a low-density image portion, a good image can be actually obtained.

<<Third Embodiment>>

According to the third embodiment, there is provided an image forming apparatus which improves image quality by setting the thickness of a liquid toner film to a predetermined value by applying liquid toner made of a transparent resin that is not directly associated with image formation onto an image carrier with respect to a low-density image portion in which the liquid toner film is thin.

Like the first embodiment, the third embodiment copes with a primary transfer failure in a low-density image portion, which occurs when the surface temperature of an image carrier 201 becomes equal to or higher than a glass transition temperature $T_g$ of liquid toner in an area corresponding to an intermediate transfer medium 206.

More specifically, a determination section 131 in an image processing section 96 in FIG. 2 determines the necessity to supply liquid toner made of a transfer resin upon detecting a portion that will become a low-density image area in which a sufficient liquid toner film thickness cannot be obtained. In accordance with this determination, a processing section 132 generates an image signal for supplying liquid toner made of a transparent resin and adds it to the received image signal. In this manner, an image signal containing a signal for supplying liquid toner made of a transparent resin is generated.

Figure 8:
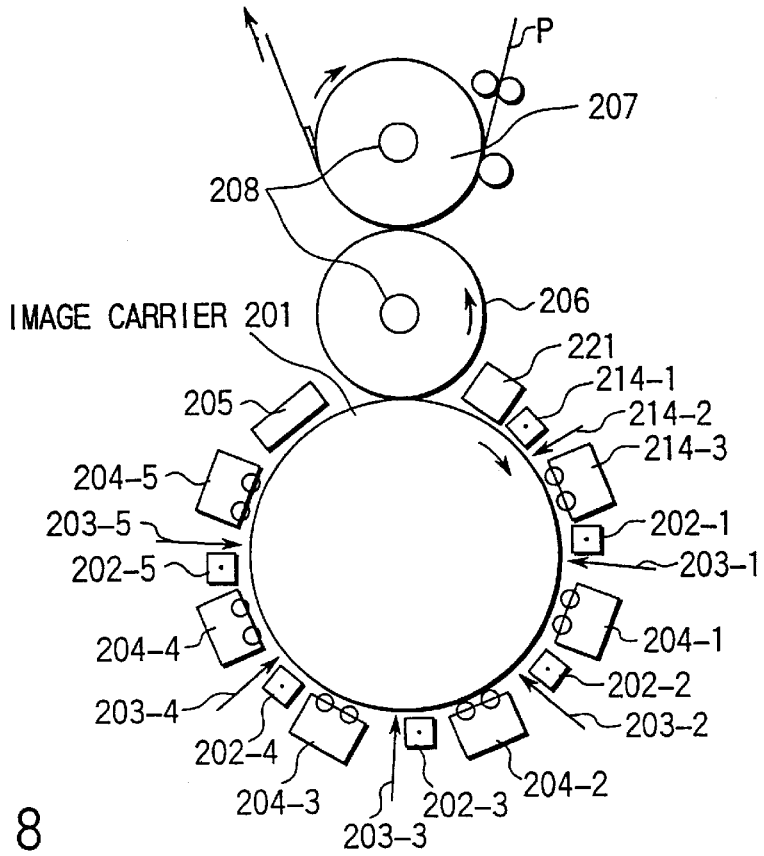
FIG. 8 is a sectional view showing the arrangement of the main part of the third embodiment.

As shown in FIG. 8, a charger 214-1 and transparent resin developing unit 214-3 are disposed between a cleaner 221 and a charger 202-1 around the image carrier 201, and the image carrier 201 is irradiated with laser exposure light 214-2 from a laser generating unit (electrostatic latent image forming means) through the space between the charger 214-1 and the transparent resin developing unit 214-3.

That is, the charger 214-1, transparent resin developing unit 214-3, and laser exposure light 214-2 constituting a station for applying (coating) a transparent resin are disposed upstream a pre-transfer drying means 205 independently of an image forming section for forming a visible image so as to apply a transparent resin having a thickness of about 0.2 $\mu$m and aiming at increasing the thickness of a liquid toner layer in a visible image portion on the image carrier 201. Other arrangements are the same as those of the first embodiment.

If, for example, a CMYK signal has a low-density image portion, as indicted by (a) in FIG. 6B, transparent toner is supplied as needed by using a transparent toner signal like the one indicated by (b) in FIG. 6B. With this signal, the final composite liquid toner film has the same thickness as that of a toner film from which a low-density image portion is removed. With this application of a transparent resin, even a low-density image portion in which the liquid toner layer is likely to be thin apparently becomes equivalent to an image portion in which the liquid toner layer is thickened. With this processing, substantially no thin-layer portion is formed, and primary transfer of even a low-density image portion can be performed. In addition, liquid toner with a low glass transition temperature $T_g$ can be used, and the temperature required for secondary transfer and fixing of the image in the intermediate transfer medium 206 need not be high. From the viewpoint of the apparatus as a whole, a great reduction in power consumption can be attained as compared with the conventional dry type liquid toner scheme.

As a transparent resin, a resin obtained by dispersing an additive such as a metal soap into the same resin as that in another type of color liquid toner may be used. However, the same type of resin containing no pigment tends to be soft and decrease in glass transition temperature $T_g$. For this reason, a resin with viscoelasticity almost equal to that of liquid toner is preferably used.

A transparent resin may be applied to an entire image portion. However, in order to suppress consumption, a transparent resin is preferably applied to only a low-density image portion in which the liquid toner layer is thin. No problem arises in terms of performance even if the transparent resin layer is excessively thick. In consideration of consumption, however, the thinner the better. In addition, a transparent resin may be applied before an electrostatic latent image is developed. Alternatively, when images of a plurality of colors are to be developed, a transparent resin may be overlaid/developed in the process of developing the images.

In place of the charger 214-1, laser exposure light 214-2, and transparent resin developing unit 214-3, a charger 202-5 and developing unit 204-5 may be disposed between a developing unit 204-4 and the pre-transfer drying means 205 around the image carrier 201 so as to irradiate the image carrier 201 with laser exposure light 203-5 from a laser generating unit (electrostatic latent image forming means) through the space between the charger 202-5 and the developing unit 204-5.

FIG. 9 shows a summary of the evaluations of experimental results on image formation with or without the application of the first, second, and third embodiments.

In the first embodiment, the transfer efficiency of a low-density image portion increased, and the low-density image portion could be properly transferred. However, since the practical resolution was decreased, apparent graininess slightly deteriorated.

In the second embodiment, the transfer efficiency of a low-density image portion did not increased much, and the transfer residue on the photosensitive body (image carrier) increased. In addition, the transfer efficiency was partly unstable, and density unevenness and the like were slightly recognized. However, a good low-density image without any deterioration in graininess could be obtained.

In the third embodiment, the apparatus arrangement was slightly complicated and the number of consumable items increased. However, a good low-density image without any deterioration in graininess and any density unevenness could be obtained.

<<Fourth Embodiment>>

According to the fourth embodiment, there is provided an image forming apparatus characterized by comprising a cooler means for setting the surface temperature of an image carrier 201 to a value lower than a glass transition temperature $T_g$ of liquid toner in an area corresponding to a developing unit 204-1 and intermediate transfer medium 206, and heater means for setting the temperature on the intermediate transfer medium 206 and the temperature of a paper sheet P to values higher than the glass transition temperature $T_g$ of transmission loss. Other arrangements are the same as those of the first embodiment.

In secondary transfer from the intermediate transfer medium to a transfer medium, the temperature of the intermediate transfer medium 206 and the temperature of the paper sheet P must be raised to values sufficiently higher than the glass transition temperature $T_g$ of liquid toner to set the complex viscoelasticity of the liquid toner on the intermediate transfer medium 206 to 10,000 poise or more by heating operation of heating means 208 for the intermediate transfer medium 206 and a final transfer member 207. Under this condition, proper transfer can be performed owing to pressure and heat.

Figure 10:
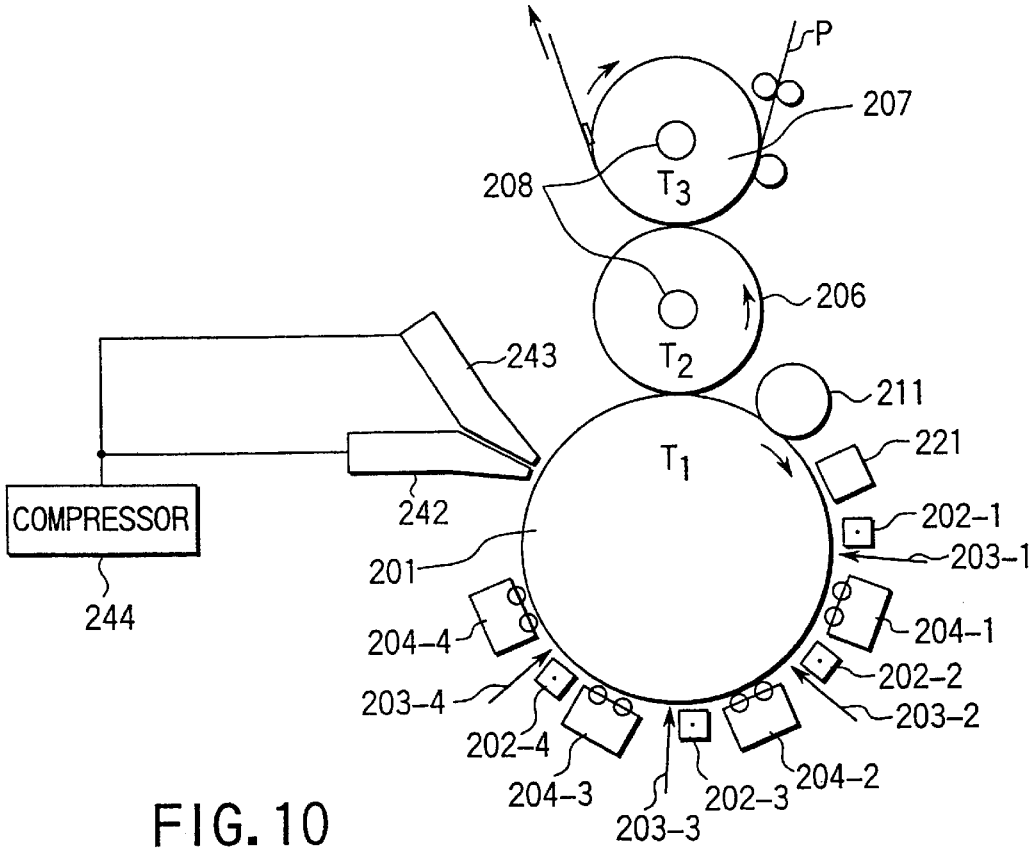
FIG. 10 is a view showing the arrangement of the main part of the fourth embodiment.

In this case, however, since the surface temperature of the image carrier 201 is raised by the heat generated by the intermediate transfer medium 206, a cooling means 11 should be disposed between the intermediate transfer medium 206 and a cleaner 221, as shown in FIG. 10, to set the surface temperature of the image carrier 201 to a value lower than the glass transition temperature $T_g$ of the liquid toner in an area corresponding to a developing means 4-1 and the intermediate transfer medium 206.

An example of the cooling means are disclosed in, for example, Jpn. Pat. Appln. KOKAI Publication No. 10-326052. This example has a cooling roller that is brought into contact with an photosensitive belt. A cooling means of this type can be used inn the present invention, too. In the example disclosed in the publication, the temperature of the photosensitive belt rises as a toner image is transferred from the belt to an intermediate transfer medium. The toner is not positively heated. However, the toner on that side of the belt which faces the intermediate transfer medium is sufficiently heated by the use of a roller of small thermal capacity at the time of transferring the toner image. In the present invention, the photosensitive body is maintained at a temperature lower than the glass transition temperature ($T_g$) of liquid toner. Hence, the photosensitive body must be cooled.

In this manner, in a development process, a drying process before transfer, and a primary transfer process, the surface temperature of the image carrier 201 is kept below the glass transition temperature $T_g$ of liquid toner so that the liquid toner is hardly dissolved on the image carrier 201, and hence does not become a uniform film (filmy). As a consequence, the contact area with the surface of the image carrier 201 becomes small. This makes it possible to easily release the liquid toner layer from the surface of the image carrier 201 and achieve proper primary transfer even with a thin liquid toner layer.

The surface temperature of the image carrier 201 may rise in the interval between the instant at which the surface of the image carrier 201 corresponds to the cooling means 11 and the instant at which the surface of the image carrier 201 corresponds to the intermediate transfer medium 206. Assume that the temperature of a liquid toner layer becomes equal to or higher than the glass transition temperature $T_g$ before primary transfer. In this case, the liquid toner layer becomes filmy and adheres to the surface of the image carrier 201 at this point of time. Even if the temperature of the liquid toner layer is lowered below the glass transition temperature $T_g$ afterward, primary transfer may not be performed.

For this reason, a pre-transfer drying means 205 is made up of blast nozzles 242 and 243, as shown in FIG. 10, and drying and cooling air (room temperature or lower temperature) is sent from a compressor 244 to these blast nozzles. Air is blown from the blast nozzles 242 and 243 against the surface of the abbreviated key 210 to dry the liquid toner layer on the image carrier 201 and cool the surface of the image carrier 201 again so as to reliably keep the surface temperature of the image carrier 201 less than the glass transition temperature $T_g$.

In an experiment, when the temperatures of the intermediate transfer medium 206 and final transfer member 207 were set to 90° C. in secondary transfer, a transfer efficiency of almost 100% could be attained at a transfer rate of 30 mm/sec.

Liquid toner whose glass transition temperature $T_g$ is about 30 to 80° C. is preferably used. In the experiment, the resins described above were combined to form liquid toner with a glass transition temperature of 45° C.

The intermediate transfer medium 206 is formed by coating a metal roller with silicone rubber or the like. This metal roller incorporates an electric heater as the heating means 208 and is always heated by the heat generated by the electric heater.

Primary transfer is mainly accomplished by the intermediate transfer medium 206 having an elastic surface, liquid toner, the pressure applied to the surface of the image carrier 201, the tack of the intermediate transfer medium 206 and liquid toner, and releasability on the surface of the image carrier 201. The surface energy of the image carrier 201 is preferably 30 dyne/cm or less, and the surface energy of liquid toner is preferably higher than 30 dyne/cm. If necessary, a silicone- or fluorine-based release layer may be formed on the image carrier 201.

In a primary transfer process, the releasability of the image carrier 201 is an important factor. If the surface energy of the photosensitive body exceeds 30 dyne/cum, proper primary transfer may not be performed with the intermediate transfer medium 206 made of silicon rubber. The same applies to a case wherein the surface energy of liquid toner is 30 dyne/cm or less. The surface energy of liquid toner was calculated by coating a glass substrate with liquid toner, drying the liquid toner to form a layer with a thickness of about 1 mm, and measuring the contact angle between Isopar.TM. L and pure water. These thresholds change depending on the value of tack of the intermediate transfer medium 206 and surface energy. However, since the transfer medium in secondary transfer is generally a paper sheet, it is difficult to greatly change the physical properties of the intermediate transfer medium 206. In addition, if an organic photosensitive layer is used for the image carrier 201, since the image carrier 201 can be easily worked into a belt-like shape or the like, some merit can be obtained in terms of the placement of developing units. On the other hand, since the image carrier 201 becomes low in heat resistance, the image carrier 201 must be protected from damage when it comes into contact with the intermediate transfer medium 206 in a primary transfer process.

If liquid toner whose glass transition temperature $T_g$ is low, e.g., 7° C. is used, and the temperature of the intermediate transfer medium 206 is set to about 70° C. in a secondary transfer process, the image carrier 201 is not greatly damaged. If, however, the temperature of the intermediate transfer medium 206 exceeds 80° C. since the electrostatic characteristics of the image carrier 201 greatly deteriorate as compared with the initial characteristics after 1,000 copies, the temperature of the intermediate transfer medium 206 in a primary transfer process is preferably set to 80° C. or less.

Incidentally, when the tack of the intermediate transfer medium 206 is strong, it can provide an image forming apparatus which uses an intermediate transfer medium 206 at a temperature equal to or lower than a glass transition temperature $T_g$ of liquid toner.

Figure 11:
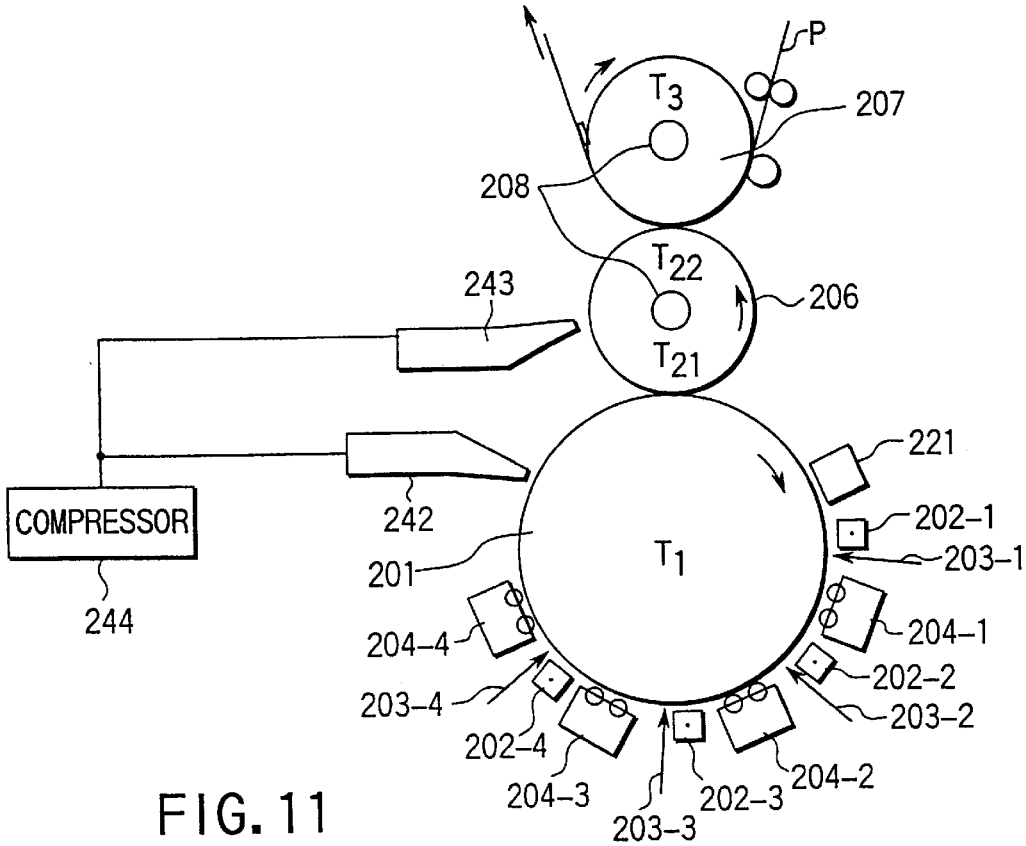
FIG. 11 is a view showing the arrangement of the main part of the fourth embodiment.

In this apparatus, a heating means 208 of the intermediate transfer medium 206 is not operated. On the other hand, in order to deal with transfer of heat from a final transfer member 207 to the intermediate transfer medium 206, one blast nozzle 213 of blast nozzles 212 and 213 is disposed to face the area between the secondary and primary transfer stations of the intermediate transfer medium 206 so as to cool the intermediate transfer medium 206 by blowing air, as shown in FIG. 11. Since the intermediate transfer medium 206 itself does not generate heat, the cooling means 11 in FIG. 10 is omitted. Other arrangements are the same as those of the fourth embodiment.

With this arrangement, a temperature $T_{21}$ of the intermediate transfer medium 206 in a primary transfer process is kept at 80° C. or less, while a temperature $T_{22}$ of the intermediate transfer medium 206 in a secondary transfer process is heated up a little by the final transfer member 207, and the transfer medium is heated up also, thereby it is possible to realize reliable secondary transfer process. However, the performance characteristic of the secondary transfer process in this case is inferior to one in the case of heating the intermediate transfer medium immediately.

The cooling means to be used is not limited to a means for supplying cooling air. For example, a similar cooling effect can be obtained by pressing a member cooled by a Peltier element or the like against the intermediate transfer medium.

<<Fifth Embodiment>>

Figure 12:
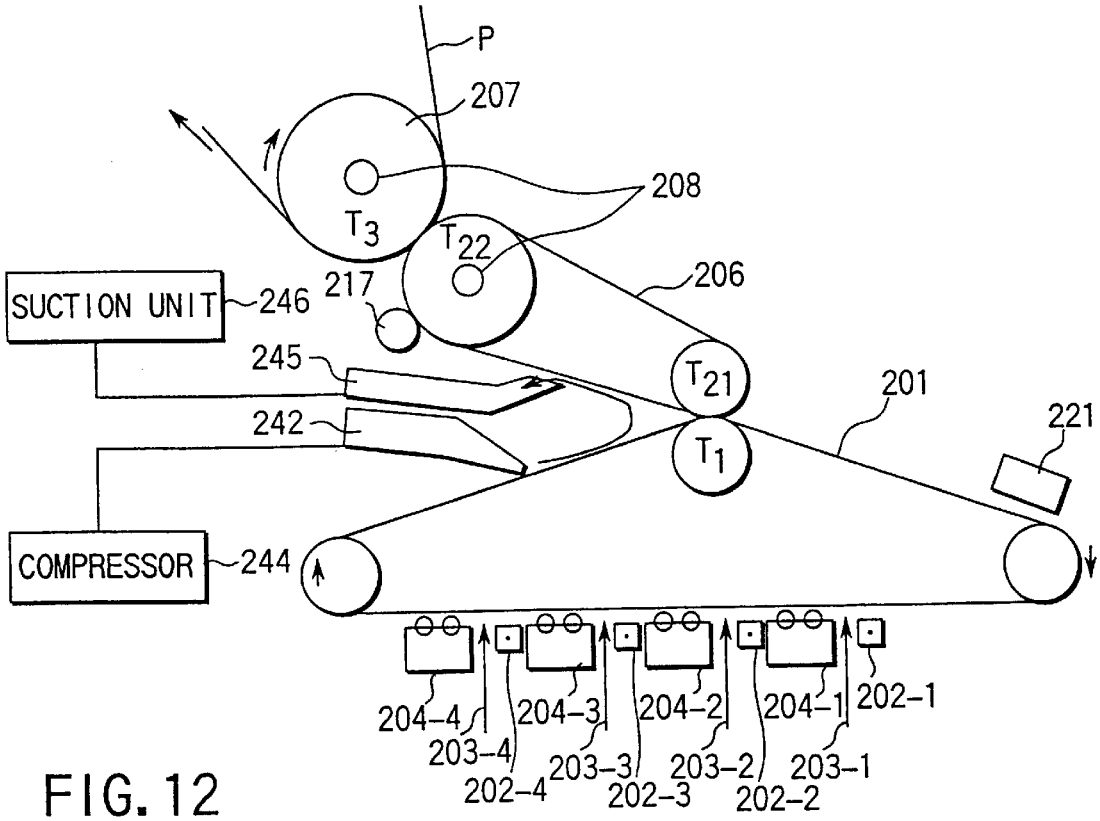
FIG. 12 is a view showing the arrangement of the main part of the fifth embodiment.

According to the fifth embodiment, considering above situation, there is provided an image forming apparatus in which an image carrier 201 and intermediate transfer medium 206 are formed by belts looped over a plurality of rollers, as shown in FIG. 12. When the intermediate transfer medium 206 takes the form of a belt, the thermal capacity can be decreased, and hence it can make easy to keep the temperature of the intermediate transfer medium to low at the first transfer and to high at the secondary transfer.

In addition, drying and cooling air blown from a blast nozzle 212 against the image carrier 201 is introduced to the intermediate transfer medium 206 as well along the surface of the image carrier 201, thus cooling the surface of the intermediate transfer medium 206. A suction nozzle 245 is disposed to face the intermediate transfer medium 206 so that the air that is introduced from the image carrier 201 to the intermediate transfer medium 206 and flows along the surface of the intermediate transfer medium 206 is drawn into a suction unit 246 through the suction nozzle 245.

U.S. Pat. No. 5,805,967 discloses a process of transferring and fixing a toner image at the same time, which is performed by using an intermediate transfer belt. In the process, the intermediate transfer medium is heated before the image is transferred from the intermediate transfer belt to the recording medium. After the image is transferred, the intermediate transfer medium is cooled in preparation for primary image transfer, thereby to prevent the toner from fusing onto the intermediate transfer medium. In the process, powder toner is used, and an electric field is applied to transfer the toner image to the intermediate transfer medium. The present invention differs in basic concept from the technique disclosed in the U.S. patent, because it has been devised to prevent heat from being transmitted to the photosensitive body.

Jpn. Pat. Appln. KOKAI Publication No. 11-65290 disclose an image forming apparatus having an intermediate transfer roller that comprises a heat-insulating cylinder and an intermediate transfer layer covering the cylinder and having a small thermal capacity. The surface of the roller is heated prior to secondary transfer and is cooled after the transfer. This technique uses liquid toner, but the primary transfer is achieved by application of an electric field. It differs from the present invention, in respect of the relation between the glass transition temperature of toner and the efficiency of transfer.

Note that, in the present invention, an intermediate transfer cleaner 217 is provided for the intermediate transfer medium 206. Other arrangements are the same as those of the fourth embodiment.

In this case, the hardnesses and loads of the press members of the belts in a primary transfer process are preferably adjusted to decrease the nip width in the primary transfer process, thereby making transfer of heat from the intermediate transfer medium 206 to the release layer of the image carrier 201 difficult. In a secondary transfer process, the hardnesses and loads of the press members are preferably adjusted to increase the nip width to sufficiently transfer heat to a liquid toner image or paper sheet P even at a high transfer rate.

The technique of increasing the secondary transfer nip is disclosed in, for example, Jpn. Pat. Appln. KOKAI Publication No. 8-220898, Jpn. Pat. Appln. KOKAI Publication No. 11-119561, and so on. In the apparatus disclosed in the publication, rollers or a belt is used as final transfer member that presses the recording medium onto the intermediate transfer medium. The use of the rollers or the belt shortens the time required for secondary transfer, thereby transferring an image at high speed. In the present invention, the secondary transfer nip is increased to achieve the same objective. In the technique disclosed in Publication No. 11-119516, however, heat is now sufficiently transmitted to the photosensitive body during the primary transfer. This is because the primary transfer is accomplished by application of an electric field. In the present invention, a pressure is applied during the primary transfer, too, from the photosensitive body and intermediate transfer medium. Thus, it is necessary to decrease the primary transfer nip, in order to control the transmission of heat from the intermediate transfer medium to the photosensitive body.

In an experiment, metal rollers each having a diameter of 50 mm were used as the press members in the primary transfer process, and a belt obtained by coating a 100-$\mu$m thick PET film with silicone rubber to a thickness of 0.5 mm was used as the belt of the intermediate transfer medium 206. When the primary transfer load was 1 kg/cm, the nip width was about 8 mm. As the press members in the secondary transfer process, rollers each obtained by coating a 100-mm diameter metal roller with silicone rubber having a hardness of 80° were used. When a load of 5 kg/cm was applied, the nip width was about 16 mm. When the nip width in a secondary transfer process is made larger than that in a primary transfer process in this manner, heat can be easily transferred from the intermediate transfer medium 206 to the release layer of the image carrier 201 (the release layer of the photosensitive body), and the secondary transfer rate can be increased.

FIG. 13 shows the experimental result on transfer, which was obtained while the temperature of the photosensitive body (the surface temperature of the image carrier 201), the temperature of the intermediate transfer medium 206, the primary transfer nip width, and the secondary transfer nip width were changed. When the surface temperature of the image carrier 201 is kept less than the glass transition temperature $T_g$ of liquid toner, primary transfer is properly accomplished. In addition, as the nip width in a secondary transfer process is increased by using the belt-like intermediate transfer medium 206, secondary transfer can be performed at a higher rate.

Figure 14:
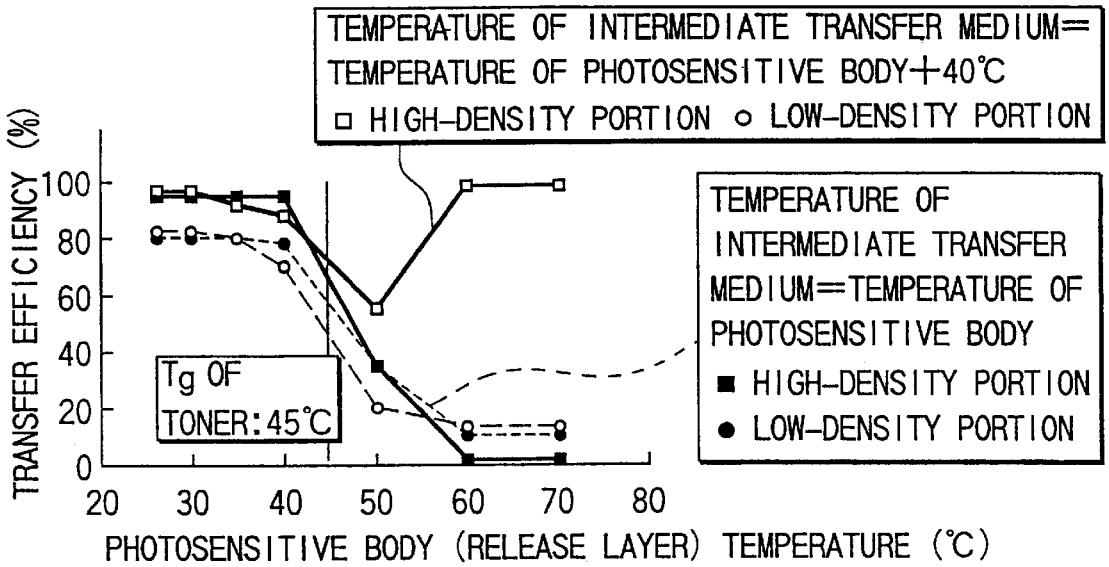
FIG. 14 is a graph showing transfer efficiencies as experimental results in the fifth embodiment.

FIG. 14 is a graph showing the behaviors of primary transfer characteristic curves when the temperature of the photosensitive body and the surface temperature of the intermediate transfer medium 206 are changed. Even if there is no temperature difference between the surface of the intermediate transfer medium 206 and the surface of the image carrier 201, both a high-density image portion and a low-density image portion can be properly transferred as long as the surface temperature of the image carrier 201 is kept less than the glass transition temperature $T_g$ of liquid toner. In a region where the surface temperature of the image carrier 201 is equal to or higher than the glass transition temperature $T_g$ of liquid toner, transfer of a high-density image portion can be improved by setting a temperature difference by heating the intermediate transfer medium 206. As is obvious, however, in this region, transfer of a low-density image portion is insufficient.

Figure 15:
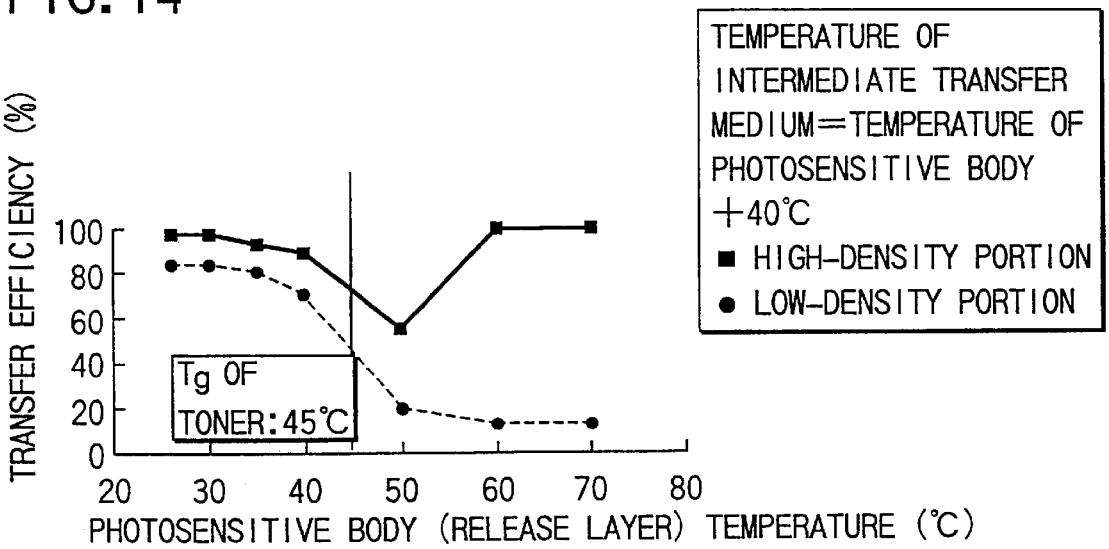
FIG. 15 is a graph showing transfer efficiencies as experimental results in the fifth embodiment.
Figure 16:
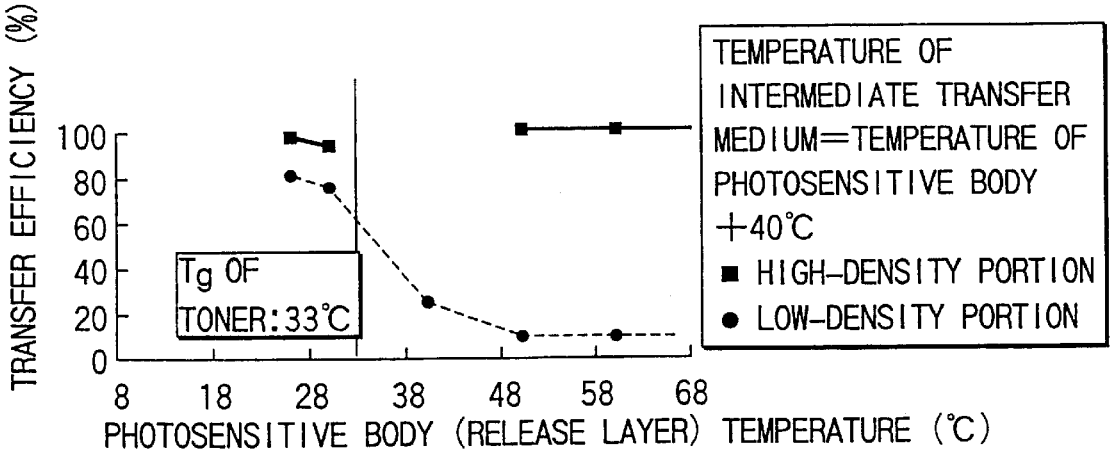
FIG. 16 is a graph showing transfer efficiencies as experimental results in the fifth embodiment.
Figure 17:
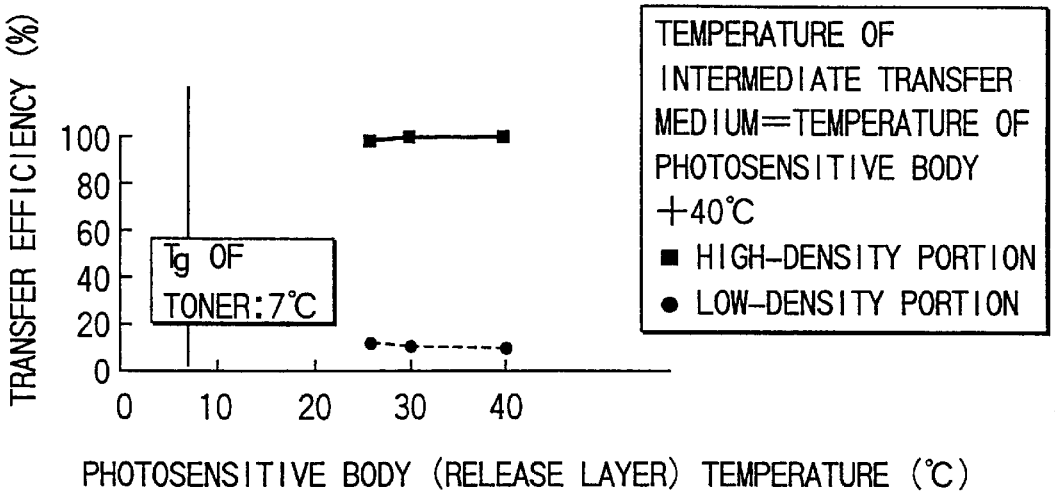
FIG. 17 is a graph showing transfer efficiencies as experimental results in the fifth embodiment.

FIGS. 15, 16, and 17 show primary transfer characteristics obtained when the glass transition temperature $T_g$ of liquid toner is changed. Obviously, the primary transfer characteristics can be categorized with reference to the glass transition temperature $T_g$. That is to say, the relations between the glass transition temperature $T_g$ of liquid toner, the temperature of the photosensitive body, and the temperature of the intermediate transfer medium, are meted to the conditions described as follows, it makes reliable transfer.

The conditions is expressed in the image forming apparatus having the arrangement shown in FIG. 12, the relationship between each component and a glass transition temperature $T_g$ of liquid toner is defined.

The respective relationships will be sequentially defined. Referring to FIG. 12, the relationship between a temperature $T_1$ of an image carrier 201 in the form of a belt and a glass transition temperature $T_g$ is defined as $T_1<T_g$. The relationship between the temperature $T_1$ of the image carrier 201 and a temperature $T_{21}$ of a portion of an intermediate transfer medium 206 which is in contact with the image carrier 201 is defined as $T_1 \geqq T_{21}$. The relationship between a temperature $T_{22}$ of a portion of the belt-like intermediate transfer medium 206 which is in contact with the final transfer member and the glass transition temperature $T_g$ is defined as $T_{22}>T_g$. The relationship between a temperature $T_3$ of a final transfer member 207 and the glass transition temperature $T_g$ is defined as $T_3>T_g$.

In order to realize such relationships, this embodiment includes a suction unit 246, a suction nozzle 245 connected thereto, a compressor 244, and a suction nozzle 242 connected thereto. In addition, in order to raise the temperatures of the intermediate transfer medium 206 and final transfer member 207, electric heaters 208 are incorporated in the metal rollers to always heat the intermediate transfer medium 206 and final transfer member 207 by generating heat from the electric heaters. The image forming apparatus according to the present invention forms images while maintaining the above temperature relationships, thus forming an image on a recording medium most reliably.

The first to eighth embodiments of the present invention have been described above. Obviously, however, the present invention is not limited to them, and various changes and modifications of the embodiments can be made within the spirit and scope of the present invention. For example, each embodiment described, uses the intermediate transfer medium 206 (206*a* or 206*b*). However, the present invention can also be applied to a case wherein transfer is directly performed from the image carrier 201 to a transfer medium such as a paper sheet.

In each embodiment described above, the image carrier 201 and intermediate transfer medium 206 (or 206*a* and 206*b*) may take the form of a drum or belt. Even with liquid toner whose glass transition temperature $T_g$ is low, the intermediate transfer medium 206 must be heated to a high temperature to perform secondary transfer at a high rate. Assume that a cooling means and the belt-like intermediate transfer medium 206 are used. In this case, if the temperature of the intermediate transfer medium 206 is set to be high in secondary transfer and low in primary transfer, both requirements for transfer performance and the durability of the image carrier 201 can be satisfied.

<<Sixth Embodiment>>

According to the sixth embodiment, there is provided an image forming apparatus which forms an image by combining two or more types of liquid toners having different glass transition temperatures $T_g$, thereby satisfactorily performing both primary transfer and secondary transfer, uses liquid toner having a glass transition temperature $T_{g1}$ and liquid toner having a glass transition temperature $T_{g2}$ ($<T_{g1}$) in a developing means, and comprises a means for setting a surface temperature $T_1$ of an image carrier 201 to $T_{g1}>T_1>T_{g2}$ in an area corresponding to an intermediate transfer medium 206.

Figure 18:
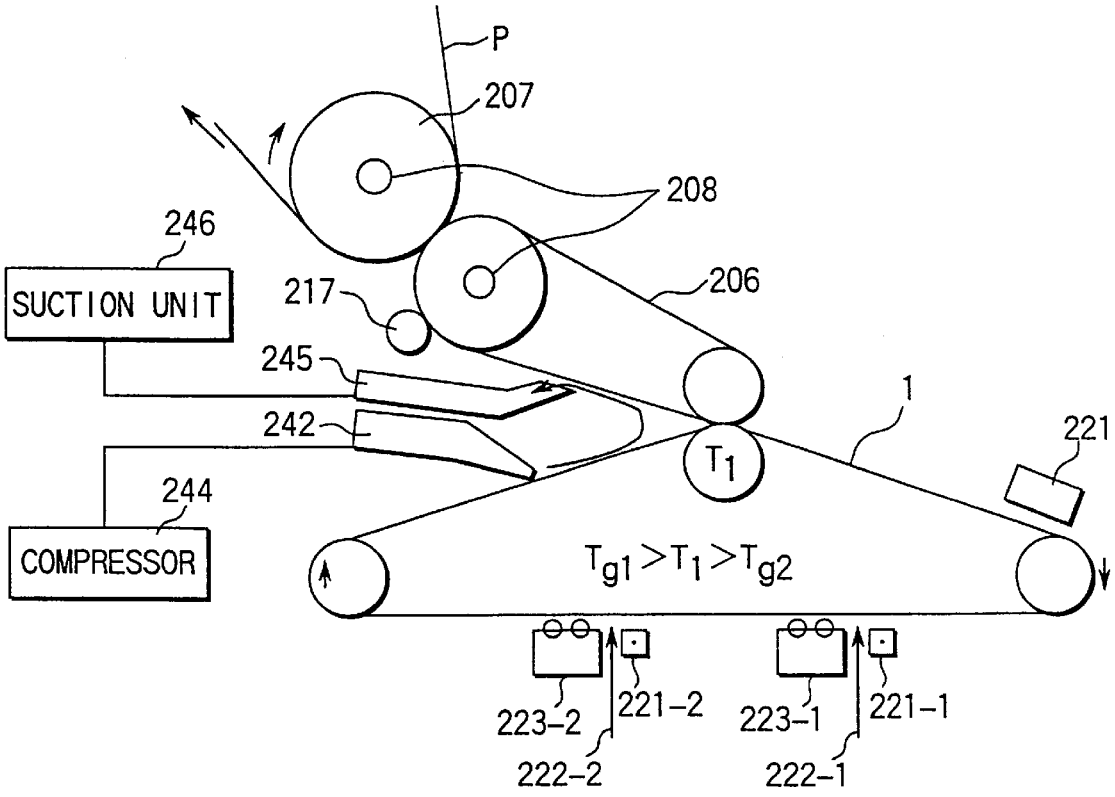
FIG. 18 is a view showing the arrangement of the main part of the sixth embodiment.

FIG. 18 shows the arrangement of this apparatus. This embodiment is a monochrome apparatus, in which a charger 221-1, developing unit (developing means) 223-1, charger 221-2, and developing unit (developing means) 223-2 are sequentially arranged along the belt surface of the image carrier 201. The area on the surface of the image carrier 201 which is located between the charger 221-1 and the developing unit 223-1 is irradiated with laser exposure light 222-1 based on an image-modulated laser beam from a laser generating unit (electrostatic latent image forming means). The area between the charger 221-2 and the developing unit 223-2 is irradiated with laser exposure light 222-2 based on an image-modulated laser beam from a laser generating unit (electrostatic latent image forming means).

Other arrangements are the same as those of the fifth embodiment.

At the developing unit 223-1, a low-density image portion in which the liquid toner layer is likely to become thin is developed by using the liquid toner having a high glass transition temperature ($T_{g1}$). At the developing unit 223-2, a high-density image portion in which the liquid toner layer becomes thick is developed by using the liquid toner having a low glass transition temperature ($T_{g2}$). The surface temperature $T_1$ of the image carrier 201 in the primary transfer process is set to an intermediate value between the glass transition temperatures $T_g$ of the two types of liquid toners ($T_{g1}>T_1>T_{g2}$). With this setting, the low-density image portion developed by the developing unit 223-1 is transferred by the same scheme as that in the fourth embodiment, and a thick liquid toner layer portion becomes completely filmy and is subjected to primary transfer. In secondary transfer, since the glass transition temperature $T_{g2}$ of the thick liquid toner layer is low, in particular, transfer can be performed at a lower temperature than in the fourth embodiment.

According to an experiment, the developing unit 223-1 developed an image by using liquid toner whose glass transition temperature $T_{g2}$ was 7° C., and the developing unit 223-2 developed an image by using liquid toner whose glass transition temperature $T_{g1}$ was 45° C.

In the present invention, since a low-density image portion is formed by using the liquid toner whose glass transition temperature $T_{g1}$ is high, transfer can be properly performed even with a thin liquid toner layer. In performing secondary transfer through the intermediate transfer medium 206, since the toner layer is thin, the thermal capacity becomes small. This makes transfer at a relatively low temperature possible. A high-density image portion is formed by using the liquid toner whose glass transition temperature $T_{g2}$ is low, and hence the liquid toner layer becomes a perfect film. This makes transfer more stable, and hence secondary transfer through the intermediate transfer medium 206 can be performed at a lower temperature.

FIG. 19 shows experimental results on image formation. As is obvious, the use of two types of liquid toners having different glass transition temperatures $T_g$ is more advantageous to secondary transfer without any deterioration in performance for primary transfer than the use of two types of liquid toners whose glass transition temperatures $T_g$ are both high.

Although the monochrome apparatus has been exemplified, the present invention can also be applied to a multicolor apparatus.

<<Seventh Embodiment>>

According to the seventh embodiment, there is provided an image forming apparatus comprising a developing device that handles liquid toner having a glass transition temperature $T_{g3}$, a developing device for applying a transparent resin having a glass transition temperature $T_{g4}$ ($>T_{g3}$) higher than the glass transition temperature $T_{g3}$ onto an image carrier 201 before the toner is developed, and a means for setting a surface temperature $T_1$ of the image carrier 201 to $T_{g4}>T_1>T_{g3}$ in an area corresponding to an intermediate transfer medium 206.

Figure 20:
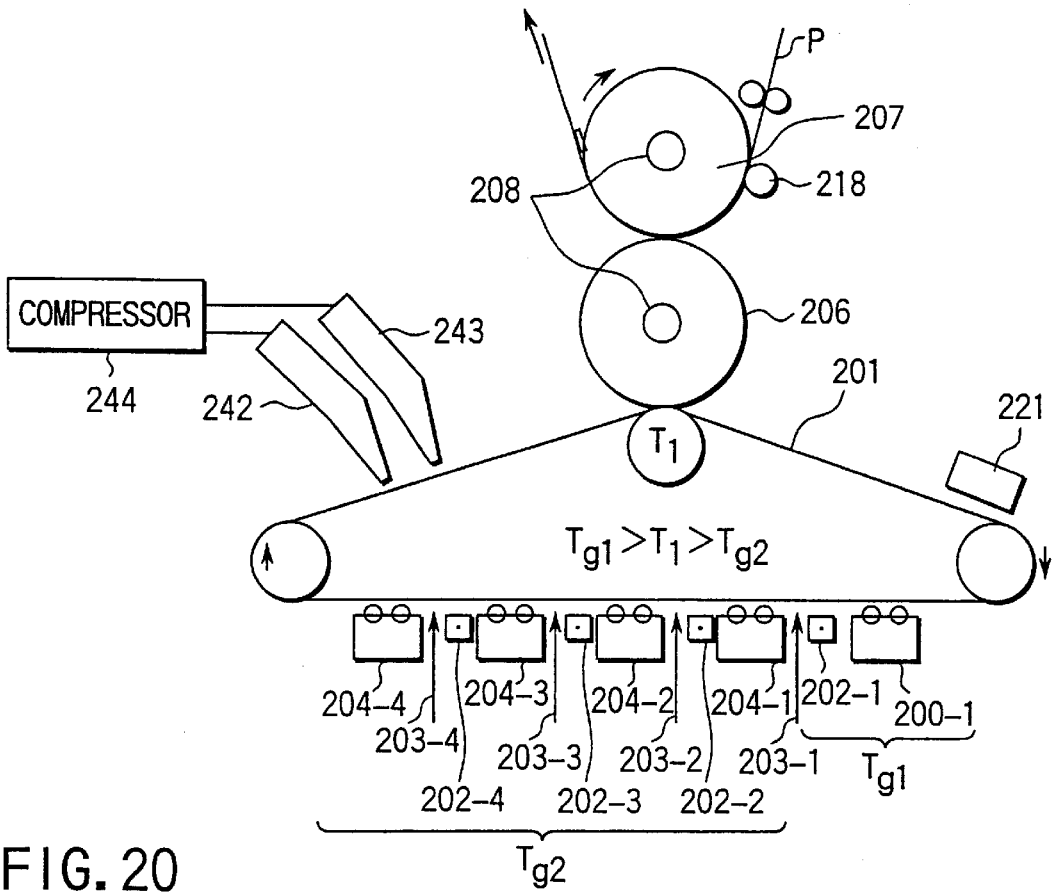
FIG. 20 is a view showing the arrangement of the main part of the seventh embodiment.

FIG. 20 shows the arrangement of this apparatus. The image carrier 201 takes the form of a belt. The intermediate transfer medium 206 takes the form of a roller. A developing unit (transparent resin coating means) 200-1, charger 202-1, developing unit (developing means) 204-1, charger 202-2, developing unit (developing means) 204-2, charger 202-3, developing unit (developing means) 204-3, charger 202-4, developing unit (developing means) 204-4, and blast nozzles (pre-transfer drying means) 12 and 13 are sequentially arranged along the belt surface of the image carrier 201.

The area on the surface of the image carrier 201 which is located between the charger 202-1 and the developing unit 204-1 is irradiated with laser exposure 203-1 based on an image-modulated laser beam from a laser generating unit (electrostatic latent image forming means). The area between the charger 202-2 and the developing unit 204-2 is irradiated with laser exposure light 203-2 based on an image-modulated laser beam from a laser generating unit (electrostatic latent image forming means). The area between the charger 202-3 and the developing unit 204-3 is irradiated with laser exposure light 203-3 based on an image-modulated laser beam from a laser generating unit (electrostatic latent image forming means). The area between the charger 202-4 and the developing unit 204-4 is irradiated with laser exposure light 203-4 based on an image-modulated laser beam from a laser generating unit (electrostatic latent image forming means).

Note that a final transfer cleaner 18 is provided for a final transfer member 207. Other arrangements are the same as those of the fifth embodiment.

The image carrier 201 is provided (coated) with a transparent resin by using the developing unit 200-1 before development, and the surface temperature of the image carrier 201 is kept lower than a glass transition temperature $T_g$ of the transparent resin in the interval between development and transfer. This facilitates transfer from the release layer of the image carrier 201. In this case, even if the glass transition temperature $T_g$ of the liquid toner is set to be low, good releasability can be maintained between the surface of the image carrier 201 and the liquid toner layer by the transparent resin having the high glass transition temperature $T_g$. Even if, therefore, the liquid toner layer is very thin, transfer can be performed.

In performing secondary transfer through the intermediate transfer medium 206, a liquid toner image must be heated to a temperature equal to or higher than the glass transition temperature $T_g$ of the transparent resin provided in advance. If, however, the transparent resin is thin, transfer can be performed at a relatively low temperature. That is, a low-density image portion can also be transferred properly by only uniformly coating the surface of the image carrier 201 with a thin transparent resin. In addition, a material whose glass transition temperature $T_g$ is relatively low can be selected for liquid toner itself, the temperature for secondary transfer through the intermediate transfer medium 206 can be suppressed low as compared with the fourth embodiment.

Note that the image carrier can be coated with the transparent resin mechanically instead of using the developing unit. In this embodiment, in order to obtain a thin film which is as uniform as possible, the developing unit 200-1 is used. In using this developing unit 200-1, the transparent resin coating stage need not use any charger and laser exposure.

A transparent resin adheres to a non-image portion. Since the transparent resin layer is very thin, even if the resin adheres to a final image, it can be neglected. The thickness of a transparent resin layer can be reduced to about 0.01 to 1 $\mu$m, and the effect of the coating does not change much whether it is thick or thin. From the viewpoint of a reduction in power consumption, the thickness is preferably 0.1 $\mu$m or less.

In an experiment, a transparent resin layer having a thickness of about 0.1 $\mu$m was formed on the image carrier 201 by applying a developing bias without charging the image carrier 201 in advance. As this transparent resin, a resin whose glass transition temperature $T_g$ was 45° C. was used, and the surface temperature of the image carrier 201 was always set to 40° C. or lower. Thereafter, development was performed by using liquid toner. As this liquid toner, toner whose glass transition temperature $T_g$ was 7° C. was used. At the time of development, therefore, the liquid toner became filmy on the image carrier 201. If this apparatus is a multicolor machine, images of a plurality of colors are overlaid and developed and reach blast nozzles 212 and 213 as pre-transfer drying means. The liquid toner layer and transparent resin on the image carrier 201 are almost dried by air blown from the blast nozzles 212 and 213.

In a primary transfer process, since the transparent resin kept at the glass transition temperature $T_g$ or lower is interposed between the surface of the image carrier 201 and the filmy liquid toner layer, the toner layer is released from the release layer at the transparent resin portion. This makes proper transfer even with a thin liquid toner layer possible.

In a secondary transfer process, since a visible image portion is formed by liquid toner whose glass transition temperature $T_g$ is low, the image portion can be stably transferred onto a paper sheet P as compared with the fourth embodiment.

In an experiment, when the temperatures of the intermediate transfer medium 206 and final transfer member 207 were set to 70° C. in a secondary transfer process, a transfer efficiency of nearly 100% could be achieved at a transfer rate of 300 mm/sec.

If the glass transition temperature $T_g$ of a transparent resin to be applied in advance is further increased, the image carrier 201 and the liquid toner layer thereon can be heated before primary transfer. This makes quicker drying before transfer possible. According to the arrangement of the fourth embodiment, if the glass transition temperature $T_g$ of liquid toner is increased, the temperature required for secondary transfer is also increased. This increases the power consumption. This embodiment can avoid such a situation.

FIG. 21 shows experimental results on image formation.

<<Eighth Embodiment>>

Figure 22:
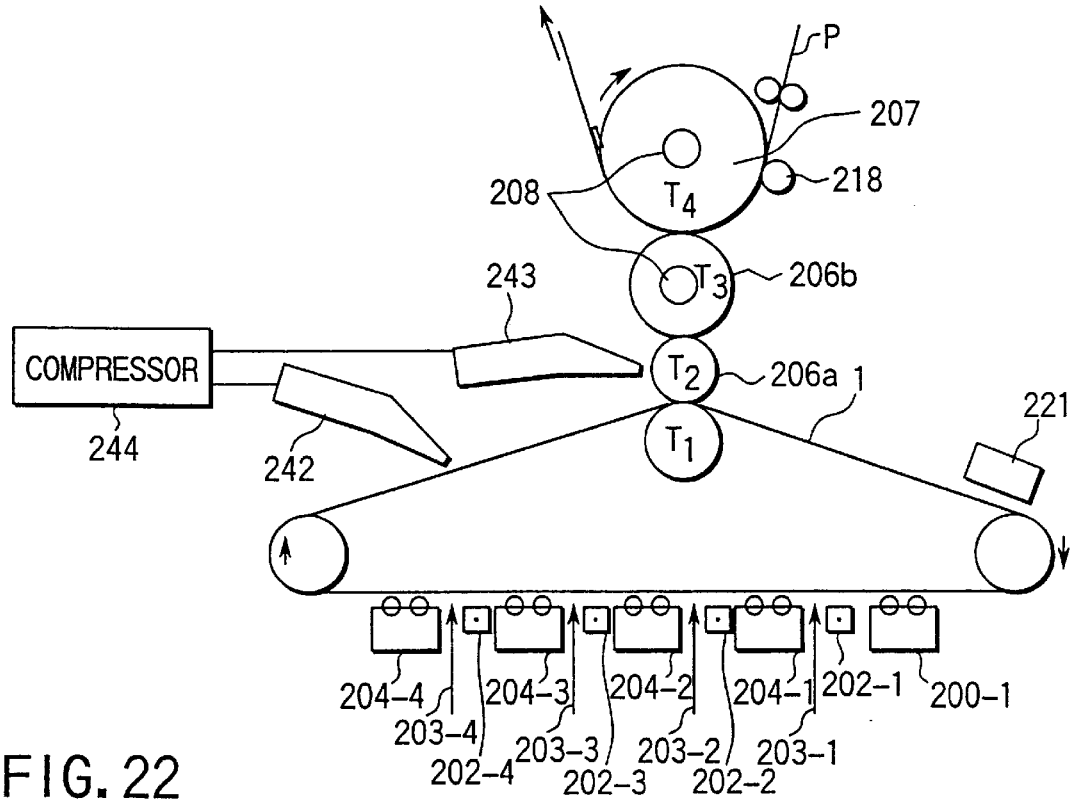
FIG. 22 is a view showing the arrangement of the main part of the eighth embodiment.

According to the eighth embodiment, there is provided an image forming apparatus comprising two intermediate transfer media 206*a* and 206*b*, as shown in FIG. 22.

A final transfer member 207 presses a paper sheet P against the second intermediate transfer medium 206*b* to transfer a visible image on the second intermediate transfer medium 206*b* onto the paper sheet P. Although the second intermediate transfer medium 206*b*, has a heating means 208, the first intermediate transfer medium 206*a* has no heating means.

In order to deal with transfer of heat from the second intermediate transfer medium 206*b* to the first intermediate transfer medium 206*a*, one blast nozzle 213 of blast nozzles 212 and 213 is disposed to face the area between the secondary and primary transfer stations of the first intermediate transfer medium 206*a* so as to cool the first intermediate transfer medium 206*a* by sending air to it. Other arrangements are the same as those of the seventh embodiment.

The use of the two intermediate transfer media 206*a* and 206*b* is more advantageous to secondary transfer. A visible image is formed on an image carrier 201 by overlaying a liquid toner layer having a glass transition temperature $T_g$ on a transparent resin whose glass transition temperature $T_g$ is high. With the use of a general single intermediate transfer medium 206, the transparent resin whose glass transition temperature $T_g$ is high faces the paper sheet P in secondary transfer. With the use of another intermediate transfer medium, in final transfer (tertiary transfer) to the paper sheet P, the liquid toner layer whose glass transition temperature $T_g$ is low faces the paper sheet P. For this reason, transfer to the paper sheet P can be performed at a lower temperature. That is, transfer can be properly performed at almost the same temperature as that in a case wherein an image is formed by using only liquid toner whose glass transition temperature $T_g$ is low.

In addition, the first intermediate transfer medium 206*a* has no heating means, and the first intermediate transfer medium 206*a* is cooled by air blown from the blast nozzle 213 so as to deal with transfer of heat from the second intermediate transfer medium 206*b* to the first intermediate transfer medium 206*a*. This prevents an unnecessary rise in the temperature of the image carrier 201.

As the cooling means for the first intermediate transfer medium 206*a*, the blast nozzle 213 is used. However, the roller forming the first intermediate transfer medium 206*a* may be internally cooled by air or water to prevent the roller itself from being easily heated, or a Peltier element or the like may be incorporated in the roller.

In an experiment, an urethane sheet was used for the first intermediate transfer medium 206*a*, and a silicone sheet was used for the second intermediate transfer medium 206*b*. Primary transfer is mainly accomplished by the surface characteristics of urethane and the releasability of the image carrier 201. Secondary transfer is mainly accomplished by the tack of the silicone sheet and liquid toner. Both the transfer processes require no heating. Tertiary transfer is accomplished by heat and pressure using the releasability of silicone, as described above.

FIG. 23 shows experimental results on image formation. obviously, the use of two intermediate transfer media makes it possible to perform better image formation than the use of one intermediate transfer medium.

<<Conclusion>>

As has been described above, according to the present invention, in forming images by using liquid toner in the image forming apparatus, even if a liquid toner layer on the image carrier is thin, a low-density image portion can be removed by detecting the low-density image portion and converting the corresponding signal into an image signal for forming a high-density image. Therefore, an image forming apparatus can be provided, which can form a sharp, high-quality image even by using liquid toner, with which image quality tends to deteriorate in the prior art.

In addition, according to the present invention, there is provided an image forming apparatus which uses transparent resin toner as well as liquid toner to form a liquid toner film with a sufficient thickness as a whole by applying the transparent resin toner to a portion in which the liquid toner film is likely to become thin, as needed, thereby realizing high-quality printing.

Furthermore, according to the present invention, there is provided an image forming apparatus in which the relationships between the temperature of an image carrier, the glass transition temperature $T_g$ of liquid toner, the temperature of an intermediate transfer medium, and the temperature of a final transfer member are defined in image formation of liquid toner using the intermediate transfer medium, and a cooling unit and heating unit are provided for each component to realize these temperature relationships, thereby attaining reliable, high-quality image formation even by using liquid toner.

Moreover, according to the present invention, there is provided an image forming apparatus in which a plurality of intermediate transfer media are used to set a sufficient temperature difference between the temperature of an image carrier, which should be lower than the glass transition temperature $T_g$ of liquid toner, and the temperature of an intermediate transfer medium and final transfer member, which should be higher than the glass transition temperature $T_g$ of liquid toner to finally form a liquid toner image on a paper sheet, thereby achieving reliable, high-quality image formation.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus which forms an image on a recording medium by using liquid toner on the basis of an electrostatic latent image formed on an image carrier in accordance with a supplied image signal, comprising:

determination means for determining whether the supplied image signal is an image signal that makes a liquid toner film have a thickness not more than a predetermined value;

image processing means for performing predetermined processing for the image signal and outputting a processed image signal when the determination means determines that the supplied image signal is an image signal that makes the liquid toner film have a thickness not more than the predetermined value;

electrostatic latent image forming means for forming an electrostatic latent image on the image carrier by irradiating the image carrier with a light from exposure means on the basis of the processed image signal output from the image processing means;

developing means for developing the image on the image carrier by using the liquid toner in accordance with the electrostatic latent image formed on the image carrier by the electrostatic latent image forming means; and transfer means for transferring the image on the image carrier, developed by the developing means, onto the recording medium.

2. An image forming apparatus according to claim 1, wherein the determination means includes means for, when the image forming apparatus performs image formation in accordance with each of image signals of a plurality of colors, determining whether a total thickness of liquid toner films based on the respective image signals of the plurality of colors is not more than a predetermined value.

3. An image forming apparatus according to claim 1, wherein the image processing means includes image processing means for, when the determination means determines that the supplied image signal is an image signal that makes the liquid toner film have a thickness not more than the predetermined value, combining a plurality of first pulses of the image signal into a second pulse having a small intermediate potential portion that generates a low-density image area, and outputting a processed image signal.

4. An image forming apparatus according to claim 1, wherein the image processing means includes image processing means for, when the determination means determines that the supplied image signal is an image signal that makes the liquid toner film have a thickness not more than the predetermined value, processing the image signal to join dispersed pixels formed by the image signal into pixel clusters each having a size not less than a predetermined size, and outputting a processed image signal.

5. An image forming apparatus according to claim 1, wherein the image processing means includes image processing means for, when the determination means determines that the supplied image signal is an image signal that makes the liquid toner film have a thickness not more than the predetermined value, outputting a processed image signal by amplification processing of the image signal with a predetermined amplification factor.

6. An image forming apparatus which forms an image on a recording medium by using liquid toner on the basis of an electrostatic latent image formed on an image carrier in accordance with a supplied image signal, comprising:

determination means for determining whether the supplied image signal is an image signal that makes a liquid toner film have a thickness not more than a predetermined value;

image processing means for outputting a processed image signal containing a control signal for applying transparent resin liquid toner onto the image carrier when the determination means determines that the supplied image signal is an image signal that makes the liquid toner film have a thickness not more than the predetermined value;

electrostatic latent image forming means for forming an electrostatic latent image on the image carrier by irradiating the image carrier with a light from exposure means on the basis of the processed image signal output from the image processing means;

applying means for applying the transparent resin liquid toner onto the image carrier in accordance with the electrostatic latent image formed on the image carrier by the electrostatic latent image forming means;

developing means for developing the image on the image carrier, onto which the transparent resin liquid toner is applied by the applying means, by using the liquid toner in accordance with the electrostatic latent image formed on the image carrier by the electrostatic latent image forming means; and transfer means for transferring the image on the image carrier, developed by the developing means, onto the recording medium.

* * * * *